US006557271B1

(12) United States Patent
Weaver, III

(10) Patent No.: US 6,557,271 B1
(45) Date of Patent: May 6, 2003

(54) SHOE WITH IMPROVED CUSHIONING AND SUPPORT

(76) Inventor: Robert B. Weaver, III, 804 144th Ave., Wayland, MI (US) 49348

( * ) Notice: Subject to any disclaimer, the term of this patent is extended or adjusted under 35 U.S.C. 154(b) by 0 days.

(21) Appl. No.: 09/878,021

(22) Filed: Jun. 8, 2001

(51) Int. Cl.[7] ..... A43B 13/18; A43B 13/20

(52) U.S. Cl. ..... 36/27; 36/89; 36/35 B; 36/29; 36/144

(58) Field of Search ..... 36/89, 27, 29, 36/35 B, 144, 7.8

(56) References Cited

U.S. PATENT DOCUMENTS

| | | | | | |
|---|---|---|---|---|---|
| 4,366,634 | A | * | 1/1983 | Giese et al. | 36/114 |
| 4,766,681 | A | * | 8/1988 | O'Rourke et al. | 36/114 |
| 4,887,367 | A | * | 12/1989 | Mackness et al. | 36/129 |
| 5,279,051 | A | * | 1/1994 | Whatley | 36/114 |
| 5,493,792 | A | | 2/1996 | Bates et al. | 36/28 |
| 5,496,263 | A | | 3/1996 | Fuller, II et al. | 602/27 |
| 5,544,429 | A | * | 8/1996 | Ellis, III | 36/114 |
| 5,561,920 | A | | 10/1996 | Graham et al. | 36/27 |
| 5,564,203 | A | | 10/1996 | Morris | 36/50.1 |
| 5,651,195 | A | | 7/1997 | Clancy | 36/11.5 |
| 5,657,767 | A | | 8/1997 | Nelson et al. | 128/882 |
| 5,659,982 | A | | 8/1997 | Muraoka et al. | 36/131 |
| 5,678,330 | A | | 10/1997 | Van Dyke et al. | 36/89 |
| 5,692,319 | A | | 12/1997 | Parker et al. | 36/50.1 |
| 5,771,608 | A | | 6/1998 | Peterson | 36/89 |
| 5,833,640 | A | | 11/1998 | Vazquez, Jr. et al. | 602/27 |
| 5,865,778 | A | | 2/1999 | Johnson | 602/27 |
| 5,875,569 | A | | 3/1999 | Dupree | 36/103 |
| 5,896,683 | A | | 4/1999 | Foxen et al. | 36/89 |
| 6,007,506 | A | | 12/1999 | Heil | 602/23 |
| 6,029,376 | A | | 2/2000 | Cass | 36/50.1 |
| 6,083,184 | A | | 7/2000 | Kenosh | 602/27 |
| 6,098,313 | A | | 8/2000 | Skaja | 36/28 |
| 6,115,943 | A | | 9/2000 | Gyr | 36/35 R |
| 6,119,373 | A | | 9/2000 | Gebhard et al. | 36/114 |
| 6,141,889 | A | | 11/2000 | Baum | 36/140 |
| 6,163,982 | A | | 12/2000 | Ellis, III | 36/25 R |

* cited by examiner

*Primary Examiner*—Ted Kavanaugh
(74) *Attorney, Agent, or Firm*—Van Dyke, Gardner, Linn & Burkhart, LLP

(57) ABSTRACT

An article of footwear of the present invention includes a sole and an upper portion, which forms a shell for enclosing a user's foot therein. The shell has a collar for extending around a user's ankle and a suspension system extending between the upper portion and the sole. The suspension system including an energy storage member, which transfers reaction forces from the sole to the shell generally at the collar whereby the energy storage member reduces overturning moment forces on the user's ankle when lateral forces are applied to the article of footwear.

36 Claims, 24 Drawing Sheets

LATERAL VIEW

LATERAL VIEW
(ANKLE JOINT)

MEDIAL VIEW

SHOE WITH IMPROVED CUSHIONING AND SUPPORT

TECHNICAL FIELD AND BACKGROUND OF THE INVENTION

The present invention generally relates to footwear and, more particularly, to footwear that provides increased stability and cushioning.

In order to reduce the impact forces on knees and ankle joints, current shoe designs incorporate a wide variety of means to cushion the foot. For example, some athletic shoes include air pockets that are incorporated into the sole of the shoe. Other problems addressed by shoe manufacturers, especially athletic shoe manufacturers, include reducing ankle strain due to over rotation. Typically, the ankle is one of the most vulnerable joints in the body, especially when engaging in athletic activities. Ankle sprains occur usually from excessive rotation of the ankle joint—both internal rotation and external rotation of the ankle joint. In an attempt to reduce the risk of ankle injury, athletic shoe manufacturers have designed footwear that restricts both medial and lateral motion of the ankle to thereby limit both internal and external rotation of the ankle. However, by restricting the ankle motion, shoe manufactures often hinder the natural motions of the foot and ankle, which tends to reduce the user's athletic performance.

Consequently, there is a need to provide footwear that reduces the risk of injury to the wearer, especially to the wearer's ankle, but in a manner that does not impede the wearer's performance, whether that performance is an athletic activity, such as running, playing basketball, playing tennis, hiking, playing racket ball, or a non-athletic activity, such as standing, for example at work, therapeutic exercises, or casual walking, or the like.

SUMMARY OF THE INVENTION

The present invention provides footwear that reduces the stress on the joints of the wearer and, further, reduces the likelihood of ankle strain.

In one form of the invention, an article of footwear includes a sole, an upper portion, and a suspension system. The upper portion includes a shell for enclosing a user's foot therein and a collar for extending around the user's ankle. The suspension system extends between the upper portion and the sole and includes an energy storage and transfer member, which transfers reaction forces from the sole to the shell generally at the collar whereby the energy storage member reduces overturning moment forces on the user's ankle by converting otherwise potentially overturning forces into stabilizing forces directed to specific locations within the ankle joint.

In one aspect, the article includes a second energy storage member, which is in series with the first energy storage member. For example, the second energy storage member may comprise a compressible body. In a further aspect, the first energy storage member comprises a pair of springs, with one of the springs located at a medial side of the article, and the other spring located at a lateral side of the article. For example, the springs may comprise leaf springs, including plastic leaf springs.

According to another form of the invention, an article of footwear includes a sole and an upper portion coupled to the sole. The sole includes a toe region, a heel region, and a central longitudinal axis. In addition, the sole includes a first lateral axis, which extends generally orthogonal to the longitudinal axis at the heel region, and a second lateral axis, which extends generally orthogonal to the longitudinal axis at the toe region. The sole includes at least one enlarged area, which extends laterally outward from the central longitudinal axis along one of the lateral axes. The sole further includes a tangent line at the enlarged area, which intersects the lateral axis and forms an angle in a range of about 40 degrees to 80 degrees with respect to the lateral axis.

In a further aspect, the shell has a collar for extending around a user's ankle. In addition, the article preferably includes a suspension system, which extends between the upper portion and the sole. The suspension system includes an energy storage member, which transfers reaction forces from the sole to the shell generally at the collar whereby the energy storage member reduces/counteracts moment forces on the user's ankle when the user leans or incurs potential overturning forces in the article of footwear.

In another aspect, the enlarged area extends outward along the first lateral axis. Alternately, the enlarged area may extend outward along the second lateral axis. In yet a further aspect, the sole includes two enlarged areas, with one of the areas extending outward along the first lateral axis, and the other extending outward along the second lateral axis.

In yet another form of the invention, an article of footwear includes a sole, an upper portion, which is coupled to the sole, and a suspension system, which extends between the upper portion and the sole. The suspension system includes a first energy storage member and a second energy storage member. The first energy storage member is in series with the second energy storage member, and with the first energy storage member providing a first resistance over a first range of motion for a wearer of the article, and the second energy storage member providing a second resistance over a second range of motion for the wearer of the article.

In one aspect, the first resistance is greater than the second resistance. For example, the first energy storage member preferably provides the first resistance over a range of motion having an angle from about 0° to 10°, while the second energy storage member provides the second resistance over a range of motion having an angle from about 5° to 15°, which creates an overlap of resistance.

In a further form of the invention, an article of footwear includes a sole and an upper portion which forms a shell for enclosing a user's foot and includes a collar for extending around a user's ankle. The article further includes a suspension system, which includes a pair of leaf springs that extend between the upper portion and the sole. The leaf springs transfer reaction forces from the sole to the shell generally at the collar whereby the leaf springs reduce moment forces on the user's ankle when the user leans or experiences potential overturning forces in the article of footwear and further provide cushioning and stability to the user's joints.

In one aspect, one of the springs is located at the medial side of the upper portion, while the other of the springs is located at the lateral side of the upper portion.

In another aspect, the springs comprise plastic or composite material leaf springs. Optionally, the springs are releasably mounted to the upper portion and the sole whereby the springs are removable for adjustment or replacement In yet another aspect, the article further includes a cushioning member that is positioned between the upper portion and the sole. The cushion member may, for example, comprise a compressible body such as a liquid or gas filled bladder/compressible container.

These and other objects, advantages, purposes, and features of the invention will become more apparent from the study of the following description taken in conjunction with the drawings.

DETAILED DESCRIPTION OF THE DRAWINGS

DETAILED DESCRIPTION OF THE PREFERRED EMBODIMENTS

Figure 1:
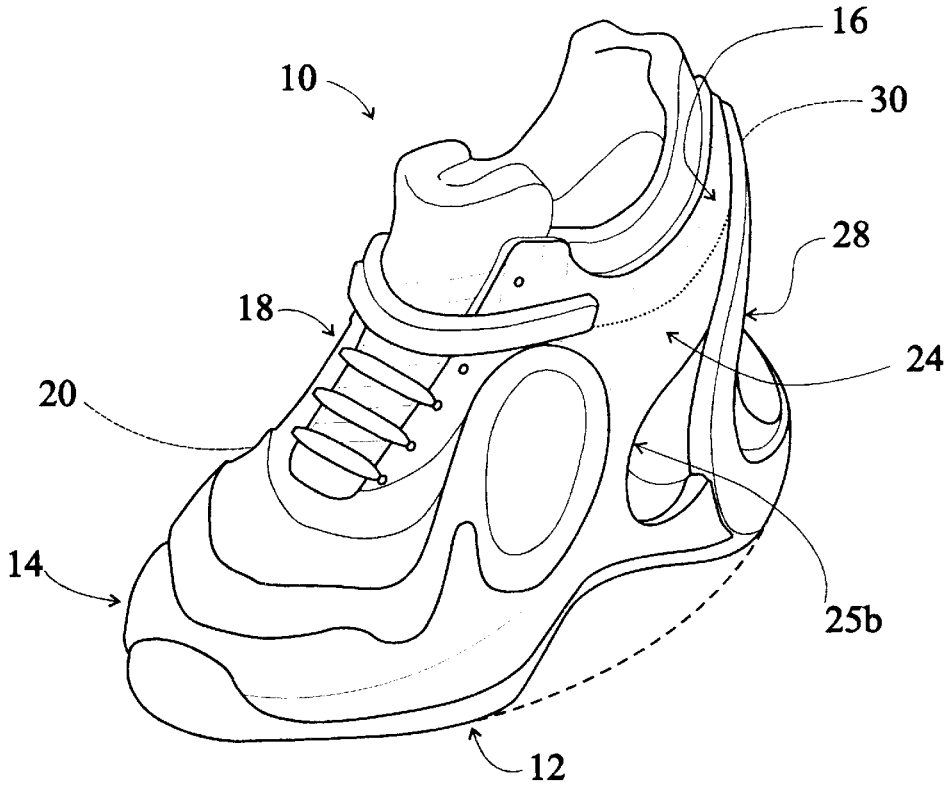
FIG. 1 is a top perspective view of the footwear of the present invention.

Referring to FIG. 1, the numeral 10 generally designates a shoe or article of footwear of the present invention. In the illustrated embodiment, the shoe of the present invention comprises athletic footwear; however, it should be understood that the various aspects of the embodiments of the shoe of the present invention may be incorporated into therapeutic footwear or everyday use footwear as well. Shoe 10 includes a sole 12 and an upper portion 14, which encloses the foot of the wearer. Upper portion 14 forms a shell, which is preferably sculptured and shaped in order to most accurately conform to the user's foot shape. In this manner, upper portion 14 transfers forces from the user's foot into the shoe's suspension system, which will be more fully described below. The shell formed by upper portion 14 is preferably made from light weight conventional materials or textiles, such as fabrics, leather, suede, or a combination of one or more of the above. Upper portion 14 optionally includes cushioning material, such as neoprene foam or open celled foam, which is positioned to evenly distribute forces from the foot to the shell by upper portion 14. Sole 12 is formed from a flexible impact absorbing material, such as rubber.

In the illustrated embodiment, upper portion 14 includes a collar 16, which surrounds the ankle joint. Preferably, collar 16 is located as high up on the ankle joint as possible, without interfering with the naturally Dorsi or Flexion movements of the ankle joint. In order not to interfere with the desired movements of the ankle joint, collar 16 is positioned and held firmly against the Talus bone (see FIG. 5) by a strap 16*a*. Preferably, collar 16 does not encroach upon the lateral or medial Malleolous bones. However, as shown by the phantom lines in FIG. 5, collar 16 may extend up over a portion of the Fibula to form a "high-top" shoe and may optionally include an opening 16' at the ankle joint around the end of the Fibula to avoid creating a pressure point at this portion of the Fibula. By positioning collar 16 at either of these locations, it is possible to supply a laterally stabilizing force vector directly to the centroid of the ankle, thus avoiding a potential overturning moment and potential ankle joint sprain. As noted previously, a sprain of the ankle may be described as an over rotation of the ankle joint—both the eversion and inversion movements of the ankle joints. Eversion is the rolling of the ankle towards the inside of the foot. Inversion is the rolling of the ankle towards the outside of the foot. Upper portion 14 also includes a lacing and tie reinforcing area 18, which completes the 360° surrounding of the ankle by connecting the two ends of collar 16 together. Reinforcing area 18 may alternatively include Velcro® straps, or the like, to connect the two ends of collar 16 together. This permits for the unbroken transfer of forces around a circumference of collar and up to the ankle joint. Furthermore, reinforcing area 18 dissipates and evenly distributes the rest of the internal forces between the user's foot and the shoe without creating overstressed areas within the shoe's material, which could lead to user discomfort and material fatigue and failure.

Figure 5:
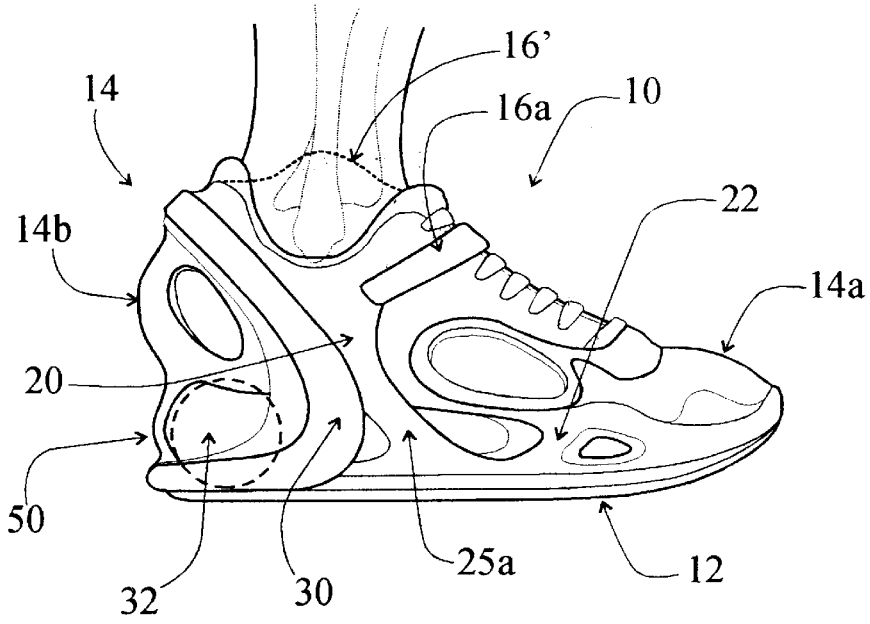
FIG. 5 is a lateral side view of the footwear of FIG. 1.

Referring to FIG. 5, upper portion 14 includes a medial longitudinal arch support 20, which is located on the medial (inner) side of the foot that extends from the medial portion of collar 16. From collar 16, medial longitudinal arch support 20 is shaped to run along the medial side of the Calcaneus and Talus bones. In addition, arch support 20 includes a strut or stabilizing bar 25*a* which extends down and curves down along the medial metatarsal bone and related bone that make up the medial longitudinal arch and, further, turns down and integrates into the lower reinforced sole at a pivot axis 22 of shoe 10. Arch support 20 provides lateral support to the medial side of the foot in order to prevent possible eversion-type ankle sprain movement. In addition, arch support 20 counteracts the minimal amount of force that a lateral longitudinal arch support (described below) applies to the ankle joint.

Referring again to FIG. 1, upper portion 14 also includes a lateral longitudinal arch support 24. The lateral longitudinal arch support 24 starts at the edge of collar 16 on the lateral (outer) side of the foot and includes a strut or stabilizing bar 25*b* that travels down to laterally support the Calcaneus, Talus, and Cuboid bones, and, thereafter, curves down to the underside of the Cuboid and Calcaneus bones, thus creating a fitted support for the lateral longitudinal arch. The lateral longitudinal arch support turns down to a bottom of upper portion 14 just before coming into contact with the fifth Metatarsal and Cuboid bone/joint. This allows the lateral longitudinal arch support to supply a comfortable yet unyielding support to the Cuboid, Calcaneus, and Talus bones in a lateral direction without creating an uncomfortable pressure point up against the fifth Metatarsal of the foot.

Inversion stabilizing bars 25*a* and 25*b* serve at least two purposes. First, inversion stabilizing bar 25*b* couples with an inversion spring (28) (described in greater detail below) to provide a consistently fluid lateral support force back into the lateral collar and thus to the lateral side of the Cuboid, Talus, and Calcaneus bones of the ankle joint. The second purpose of inversion stabilizing bars 25*a* and 25*b* is in the prevention of one specific type of ankle sprain movement. Unlike typical ankle injury movements of the inversion and eversion sprains, the forward rolling inversion (FRI) sprain does not occur at or near the 90° angle to the Dorsi/Plantar Flexion plane. The FRI sprain occurs when the outer lateral edge of the shoe located most proximate to the fifth Phalanx and Metatarsal bones 'catches' on the ground, sending a force vector back into the shoe towards the centroid of the ankle joint. A reactionary force equal and opposite to the initial force is supplied at the centroid of the ankle joint by the medial and lateral Malleolous of the Tibia and Fibula bones respectively. However, because the centroid of the ankle joint (and the origin of the reaction force) is located above, for example approximately four to five inches above, the initial force location near the fifth Phalanx bone, an overturning moment is created by the coupling of the two equal and opposite forces with a vertical distance, for example of 4 to 5 inches, separating them. Because of this overturning moment, the ankle joint ends up using the edge of the shoe at the fifth Phalanx bone as a hinge, and pivoting up and over the this edge. The result is straining tendons related to the Peroneus Tertius muscle. As will be described in greater detail in reference to sole 12, by laterally extending the portion of the sole located nearest (and posterior to) the fifth Phalanx and Metatarsal joint, a counteracting moment is created. By laterally extending this portion of the shoe out away from the typical edge of the shoe, the edge of the shoe initially comes into contact with the vertical ground force at a distance away from the edge of the foot (which serves as the pivot point of all internal foot forces back to the ankle joint). Now the creation of an ankle sprain counteracting moment is created by taking the force supplied by the ground and multiplying it by the distance the vertical ground force occurs away from the pivot point of the edge of the foot (fifth Phalanx area). This moment is transferred up into the front lateral collar via the rigid joint connection between the inversion-stabilizing bar and the sole coming in contact with the ground. This static moment reaction is transferred up the rigid inversion stabilizing bar, to the front lateral collar—this moment is used as a stabilizing force back into the Talus bone/joint area. Inversion stabilizing bars 25*a* and 25*b* transfer moments up to the collar and ankle area, which counteracts the moment by the creation of the desired stabilizing force back into the ankle joint. The moment in the inversion-stabilizing bar is created by the relation of the initial vertical ground force at the 'distance' away from the pivot point (actual edge of the foot). Thus, the counteracting moment in inversion stabilizing bars 25*a* and 25*b* is best achieved when combined with the use of an extended footprint.

As best seen in FIGS. 1, 3, 4, 5, shoe 10 includes an inversion support 28 and an eversion support 30. Inversion and eversion supports 28, 30 are preferably inversion and eversion springs that are configured to transfer the initial reaction forces initiated around the edge of springs sole 12 to upper portion 14 at the top of the shoe adjacent to or at collar 16. Preferably, inversion and eversion springs 28, 30 are connected to upper portions 14 at lateral (outer) and medial (inner) rear upper corners of upper portion 14. As a result, upper portion 14 is suspended by the two supports. Springs 28, 30 are preferably made from a lightweight material, such as plastic. Suitable plastics include a reinforced plastic, such as a mineral reinforced plastic, a carbon fiber reinforced plastic, a composite fiber or mineral reinforced plastic resin, including graphite reinforced or a composite graphite reinforced plastic. Furthermore, springs 28, 30 may be formed with sole 12 and formed, for example, by injection molding. Optionally, inversion and eversion springs 28, 30 may be removably mounted to upper portion 14, for example by fasteners, so that the springs are removable to allow a user to replace the springs with other similar springs or springs with different properties. In addition, supports 28, 30 may comprise compressed gas chambers, such as shock absorbers, with optional valves to adjust the pressure in the chambers and to provide variable gas pressure flexibility. In this manner, a user may customize their shoe to provide different cushioning and support. Therefore, shoe 10 may be adapted for many uses and is not exclusive to any single sports/activity while providing a desired amount of impact resistance and stability.

In the illustrated embodiment, spring 28, 30 extend to sole 12 and form an integral part of sole 12. As noted above and more fully described in reference to FIGS. 28 and 29, the shoe may incorporate springs that have a movable connection allowing the springs to flex more freely.

Springs 28, 30 create a slight rotation about pivot axis 22 of shoe 10, which is located approximately in line with the ball of the foot when viewed from either the medial or lateral portion. This rotation allows the upper support connections at the rear of the collar to stay exactly the same distance away from the pivot axis throughout the entire range of rotation of the shoe. Preferably, the rotation or flexure of shoe 10 coincides with the natural flexure characteristics of the user's foot.

In preferred form, inversion and eversion springs 28, 30 are pretensioned members, which form leaf-type springs that increase the shoe's stability. The increased stability is created by both springs 28 and 30 providing both a vertical resistance force and a lateral resistance force, which both supply lateral forces back towards the ankle joint and which are antagonistic to one another. Furthermore, springs 28, 30 also create counteracting lateral forces which serve to provide support in the lateral directions. As previously noted, springs 28, 30 are connected to upper portion 14 at lateral and medial rear upper corners of upper portion 14 adjacent to or at collar 16. As a result, upper portion 14 is suspended by springs 28, 30. By connecting springs 28, 30 to the top of upper portion 14, springs 28, 30 transfer the initial edge forces that occur at sole 12 directly to collar 16—in other words, directly to the height of the centroid of the ankle joint. By transferring the reaction forces up to the height of the ankle joint centroid, shoe 10 effectively eliminates the instability of the ankle joint by allowing the lateral forces to "by-pass" the bottom of the foot heel and be directly transferred into the bottom of the Tibia and Fibula bones. In addition, by connecting springs 28, 30 at or near collar 16, the sides of the springs will accommodate large amounts of vertical movement through the cushioning process and, further, will provide support throughout the entire cushioning range. In addition, by providing pretensioned springs, springs 28, 30 can supply relatively high ratio of stress to strain during the initial deflection, which then tapers off while still allowing for more deflection. In addition, spring members 28, 30 tend to create required lateral stability reaction forces up to a certain degree and then maintain these internal forces without over stressing the related joint connections, materials, which could lead to premature wear and failure of the components. As noted above, springs 28 and 30 may be made of plastic, including reinforced or a composite plastic. Additionally, as an alternate, springs 28 and 30 may be embedded into the shell of shoe 10, such as by injection molding so as to integrate the structural components with the finished exterior wear surface of sole 12.

Figure 3:
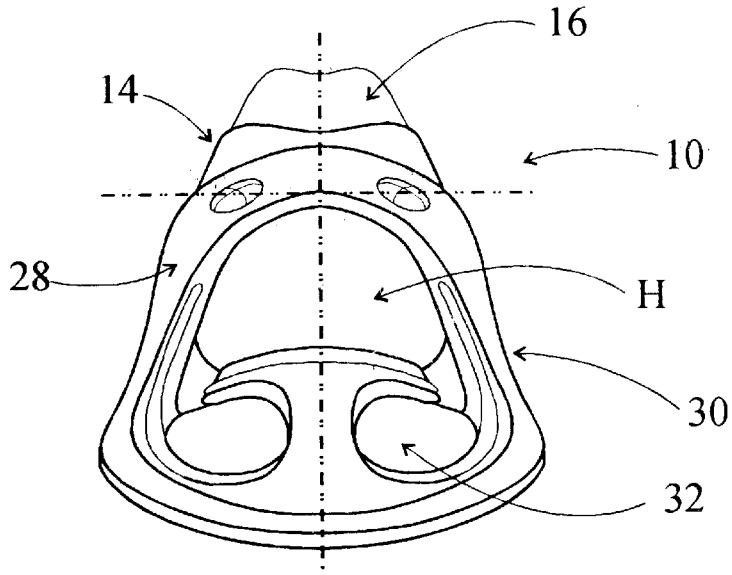
FIG. 3 is a rear elevation view of the footwear of FIGS. 1 and 2 illustrating a cushioning element of the footwear in a compressed state.
Figure 4:
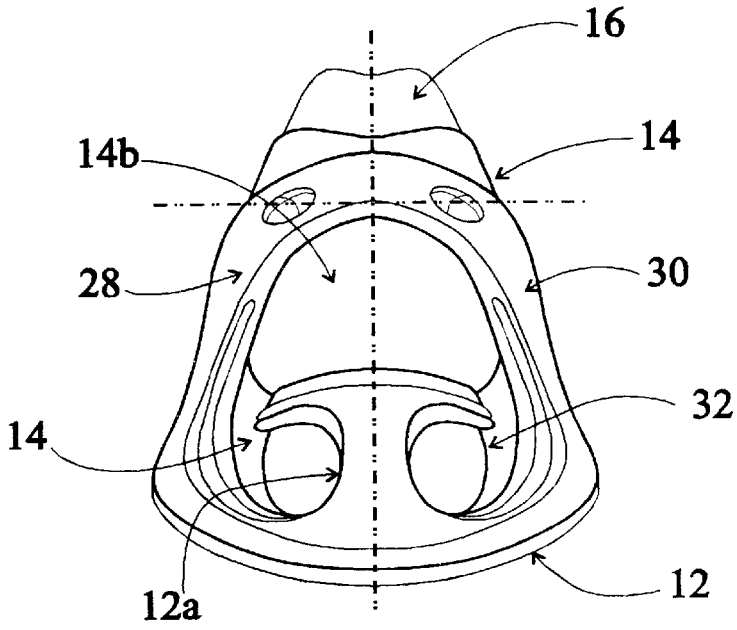
FIG. 4 is a similar view to FIG. 3 illustrating the cushioning element in a generally uncompressed state.
Figure 5A:
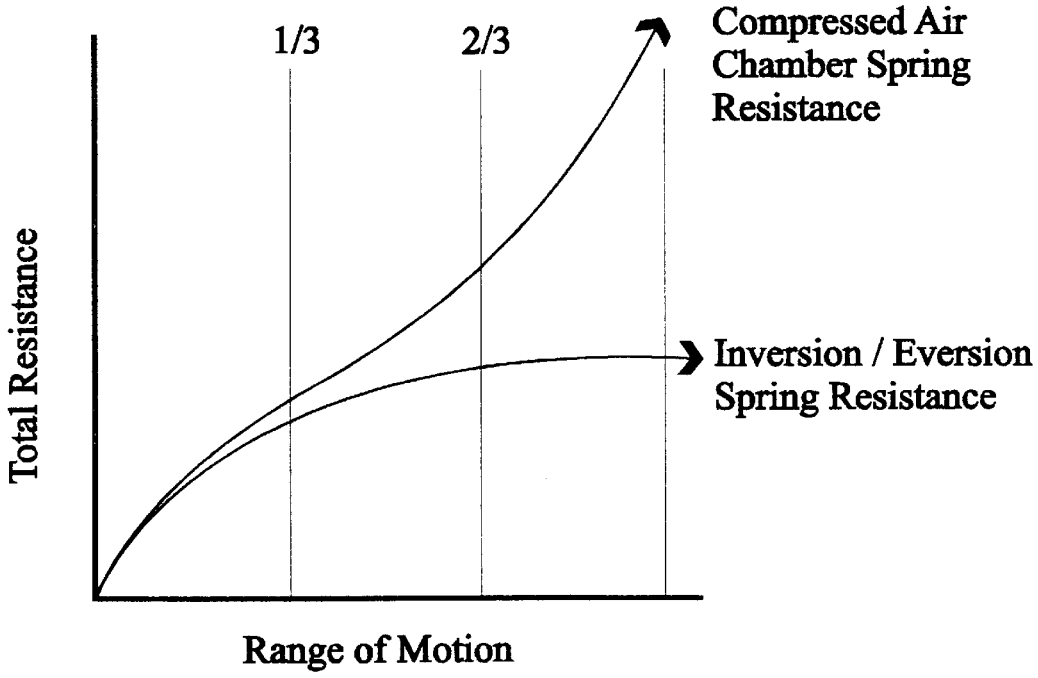
FIG. 5A is a graph illustrating the resistance of each spring component of the shoe of FIG. 1 over the range of motion of the shoe.

Referring to FIGS. 3 and 4, shoe 10 further includes a cushioning element 32. In the illustrated embodiment, cushioning element 32 comprises a flexible container, such as a gas-filled container, which is filled with a gas, preferably a compressed gas, or a liquid-filled bladder. For example, the container may comprise a neoprene foam, compressed gas-filled container, including a gas-filled cartridge. Unlike springs 28, 30, cushioning element 32 increases in resistance as the shoe deflects and as more load is applied to shoe 10. Therefore, initially, cushioning element 32 deflects or compresses without much resistance (see FIG. 5A). Referring to FIG. 5A, springs 28 and 30 optionally provide a stiffness or resistance over a first range of motion which is greater than the stiffness or resistance of cushioning element 32. For example, springs 28, 30 provide the majority of the resistance over the first ⅓ of the range of motion, for example from about 0°to 5°, while cushioning element 32 provides the majority of the resistance over the last ⅓ of motion, for example from about 10° to 15°, with both springs 28, 30 and cushioning element 32 providing an overlapping range of resistance over the middle third of the range of motion, for example from about 5° to 10°. It is not until springs 28, 30 significantly deflect, that the resistance in cushioning element 32 increases enough to become the dominant impact resisting element in the suspension system of shoe 10. For example, depending on the relative stiffness of springs 28, 30 and cushioning element 32, cushioning element 32 may not provide the dominant cushioning function until springs 28, 30 have deflected ¼ to ½ of their total deflection range.

In addition, cushioning element 32 serves as an energy storage and return system allowing the user's own kinetic energy to be temporarily stored in cushioning element 32 in the form of potential energy and then returned back to the user's heel and foot when rolling forward, such as in a running step motion. In addition, cushioning element 32 reduces the impact shock induced upon the knee joint when the user is engaged in a high impact activity, such as jogging or running or the like. The high impact, repetitive forces associated with jogging, running, and sometimes walking, often induce knee joint and tendon injury, which can be significantly reduced with the use of the shoe of the present invention.

Optionally, cushioning element 32 may be removably mounted in shoe 10 so that it can be replaced by the user to customize shoe 10. Alternately and in addition, cushioning element 32 may be adapted such that cushioning element 32 can exhibit increased or decreased resistance. For example, cushioning element 32 may be inflatable to increase the pressure in the chamber of the container or may be deflated to release the pressurized fluid or gas in the container to reduce the resistance of cushioning element 32. For example, some activities, such as walking may require less cushioning than other activities, such as running or jogging. In addition, cushioning element 32 may be exchanged or adapted to accommodate different body types and weights to customize the shoe to the suspension feel that best suits the individual user's taste and preferences. As a result, the resistance of the suspension system of the present invention may be varied not only to customize the resistance to the particular needs of the user but also to alter and/or optimize the "spring-rate" of the shoe.

The pressure in cushioning element 32 may be regulated by the use of an external pump or an internal pump. For example, cushioning element 32 may include a built-in air pump, which may be positioned in an easily accessible location. For example, such an air pump could include a small flexible cylinder or hemisphere that the user could suppress using their finger until the pressure in the cushioning element reaches its desire level. In this application, it would be desirable to include a simple pressure release valve that could be operated by hand to reduce the pressure within the suspension. Furthermore, an optional maximum pressure release valve may be provided which prevents the user from over inflating the cushioning element. It should be understood that the adjustment of the inversion and eversion springs and/or cushioning elements 32 may be used to vary and, therefore, customize the suspension of shoe 10.

Figure 2:
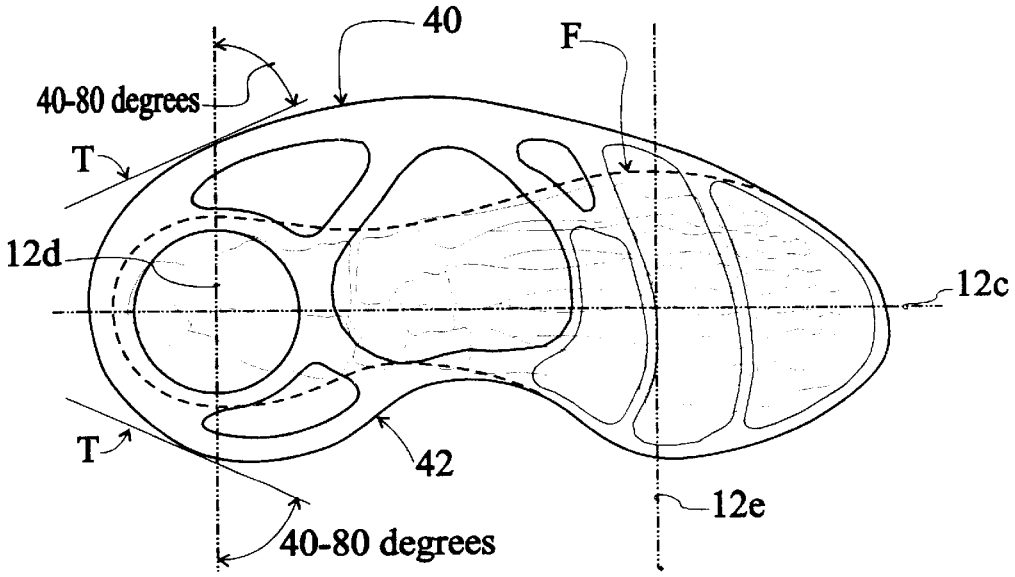
FIG. 2 is a bottom plan view of one sole of the footwear of FIG. 1.
Figure 6:
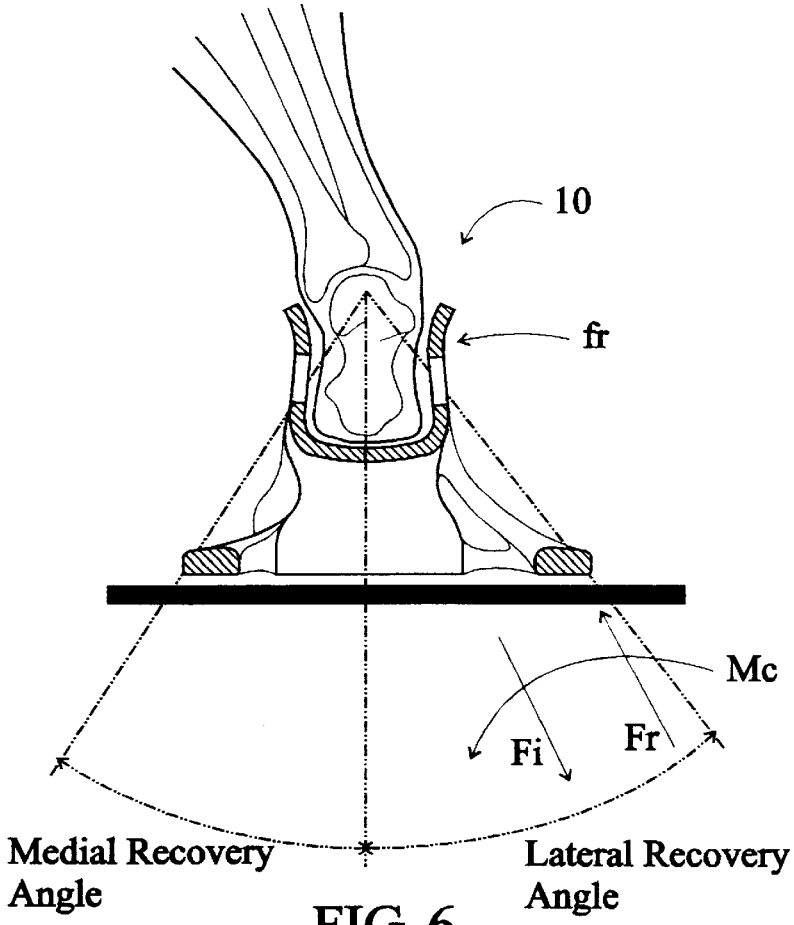
FIG. 6 is a schematic view of the forces exerted at the edge of the footwear of the present invention illustrating the correcting moment force applied to the ankle joint.
Figure 8:
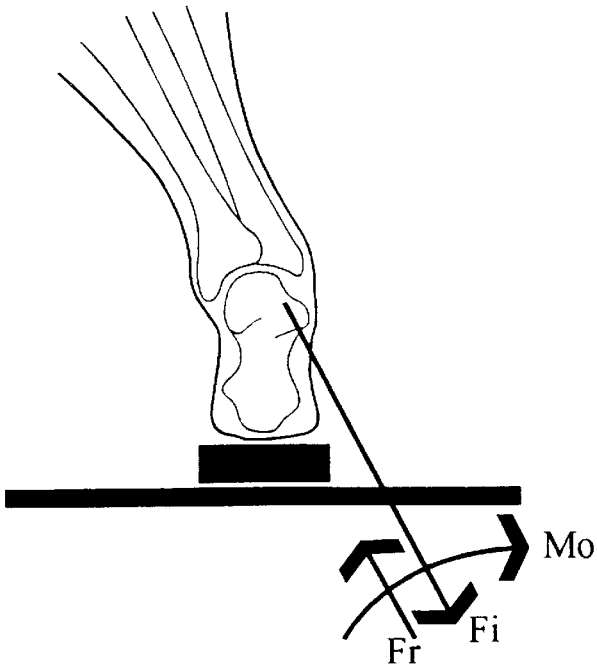
FIG. 8 is a schematic view of a standard shoe design where the foot's reaction forces expose the foot to the risk of an ankle sprain due to creation of overturning moment.

In addition to providing an improved suspension system, shoe 10 includes a sole 12 with an extended footprint. As will be more fully described below, by increasing the foot print of sole 12 over conventional shoe soles, the center of gravity of the ankle joint when wearing shoe 10 is lowered and, further, the recovery angle of shoe 10 is increased (FIG. 6). Referring to FIG. 2, sole 12 includes an enlarged lateral portion 40 and an enlarged medial portion 42 adjacent the heel of the wearer. In the illustrated embodiment, both the lateral and medial portions extend outwardly from the central longitudinal axis 12*c* of sole 12 along a line or lateral axis 12*d* (rearward of lateral axis 12*e*) that extends through the ankle centroid to for any-angle in a range of 40° to 80° to the tangent line T to the sole. By increasing the width of sole 12 as shown in FIG. 2, sole 12 aids in creating a naturally occurring ankle joint orientation correction. In a conventional shoe, a user can generally roll his or her ankle towards the outside lateral edge of the shoe without injuring the user's ankle. However, further rotation at the edge of the shoe induces ankle ligament strain and injury. When the angle created from the edge of sole 12 to the centroid of the user's ankle is greater than that of the angle of the ankle joint in relationship to the ground plane or landing, shoe 10 will correct its orientation automatically. This is accomplished through the interaction of the initial downward vector force (fi) being transferred through the centroid of the user's ankle joint, and the reaction force (fr) of the horizontal plane. The wider spacing of the sole of the shoe keeps the reaction force (fr) always to the lateral side of the centroid of the ankle joint, thus automatically creating a correcting moment (mc) between the ankle joint/shoe relationship. The intent is to allow the initial user's weight to automatically correct the orientation and positioning of the foot and ankle joint prior to the majority of the user's weight being applied and transferred back through the ankle joint and into the horizontal ground plane. Thus, preventing ankle injury through the shoe's ability to properly position the ankle joint, prior to the user's full body weight being applied. To date, all prior solutions have attempted to prevent or better minimize ankle over rotation by stiffening and immobilizing the ankle joint to better minimize the severity of the ankle joint over-rotation and concern sprain injury, due to the fact that all previous shoes still allow for the user to create a situation where the initial vector force (fi) can be located to the medial side of the ankle joint centroid, thus, creating an overturning moment ($m_o$) situation in which the ankle joint is forced to roll laterally and create an ankle sprain injury (FIG. 8).

In contrast to the prior art shoes, sole 12 minimizes the moments on the ankle due to the reaction forces of the shoe on a ground plane. As a result, sole 12 increases the potential angle of recovery of shoe 10 to significantly reduce the chance of the user over stressing his or her ankle. Furthermore, sole 12 increases the angle of recovery for both inversion and eversion movements, thus minimizing the potential of creating an over-turning moment within the ankle from either direction. Thus, shoe 10 provides a more stable support of the user's foot and ankle and, further, is more impact resistant than conventionally known shoes. Moreover, shoe 10 leaves the movement of the ankle joint of the user unencumbered and permits unrestricted Plantar and Dorsi Flexion movement.

Referring again to FIG. 5, upper portion 14 includes a forward portion 14*a*, which is connected to sole 12. In addition, upper portion 14 includes a rearward portion 14*b*, which extends upwardly from sole 12 and, further, which is suspended by springs 28 and 30 above sole 12 such that rearward portion 14*b* of upper portion 14 and sole 12 define therebetween a cavity 50. Furthermore, sole 12 includes an upwardly extending web 12*a* and flange 12*b* which connect sole 12 and rearward portion 14*b* of upper portion 14 to thereby partially enclose cavity 50. Positioned in cavity 50 forward of web 12*a* and flange 12*b* is cushioning element 32. In this manner, web 12*a* and flange 12*b* capture cushioning element 32 in cavity 50. Furthermore, web 12*a* and web 12*b* are formed of a flexible material, such as the rubber material which comprises sole 12, so that when rearward portion 14*b* of upper portion 14 moves downwardly as shown in FIG. 3, flange 12*b* and web 12*a* compress and deflect to permit the forces from the foot to be transferred to cushioning element 32. However, as noted above, the initial predominant transfer of forces from the foot through the shoe's suspension system is passed through springs 28 and 30.

Figure 7:
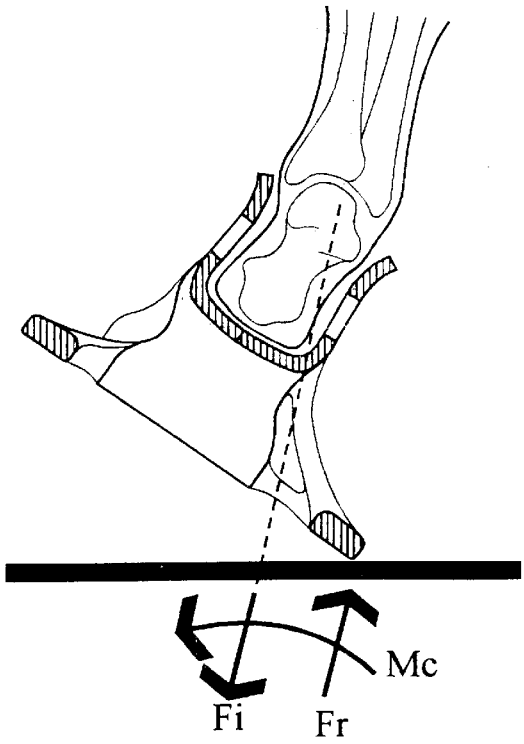
FIG. 7 is a similar view to FIG. 6 illustrating the wearer of the footwear rotating on the edge of the sole of the present invention and illustrating the initial destabilizing force counteracted by an applied reaction force and transferred up to the ankle joint.

Referring to FIG. 6, FIG. 6 illustrates how the potentially "de-stabilizing" lateral forces created from the user applying or exerting an overturning lateral force on a generally flat and horizontal surface are contained within the stability of article of footwear 10. As best seen in FIG. 6, sole 12 moves the reaction forces (fr) from the ground outwardly with respect to the ankle of the wearer of shoe 10. As noted above, by moving the initial forces (fi) outwardly from the ankle of the wearer of shoe 10, the angle of recovery of shoe 10 is increased over conventional shoes. Referring to FIG. 7, FIG. 7 illustrates now a potentially de-stabilizing initial force (fi) is counteracted by an applied reaction force (fr) and transferred up to the ankle joint via stabilizing bars 25*a*, 25*b* in order to both stabilize ankle joint from overturning, and also initiate proper rotation of shoe 10 back to its intended horizontal orientation with the horizontal plane.

Figure 9:
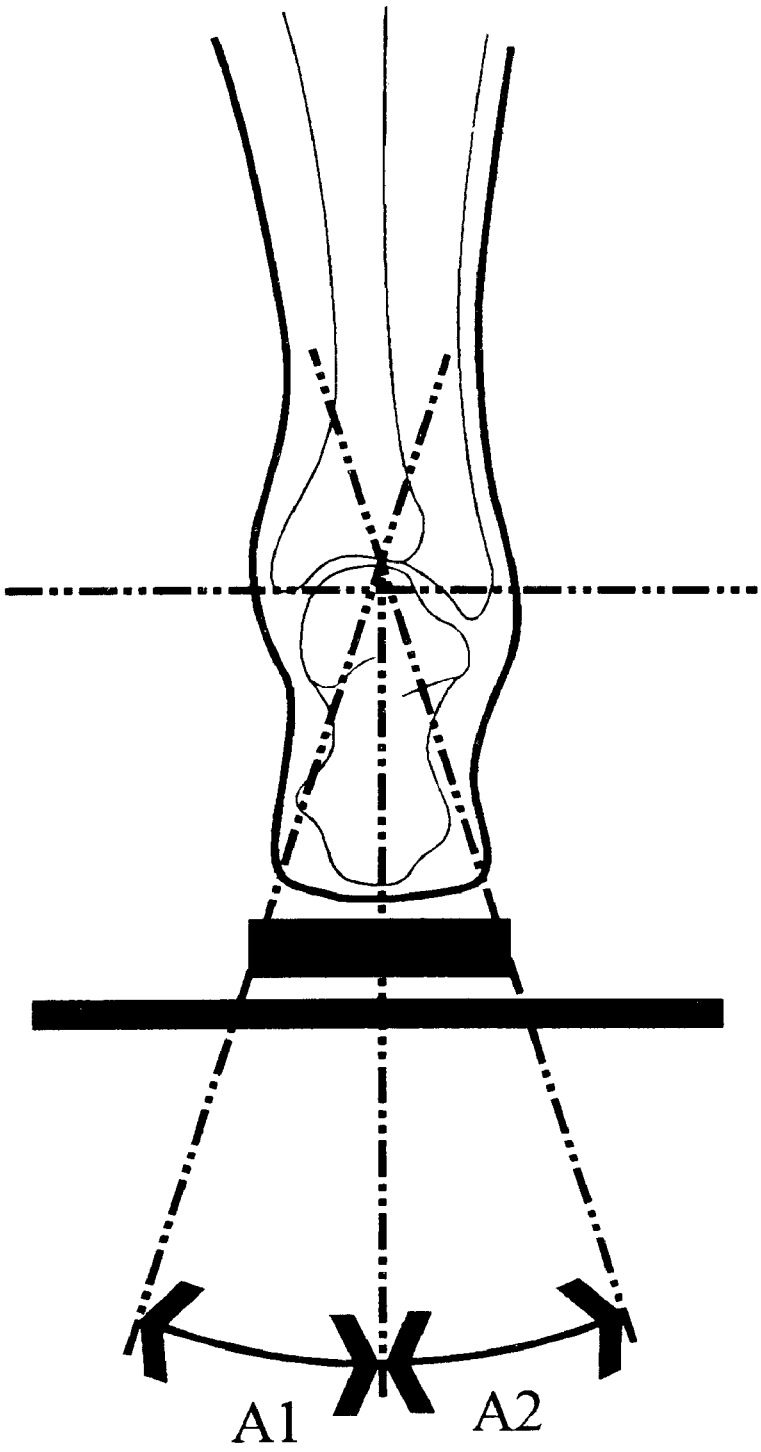
FIG. 9 is a schematic view illustrating the recovery angles of standard footwear design.
Figure 10:
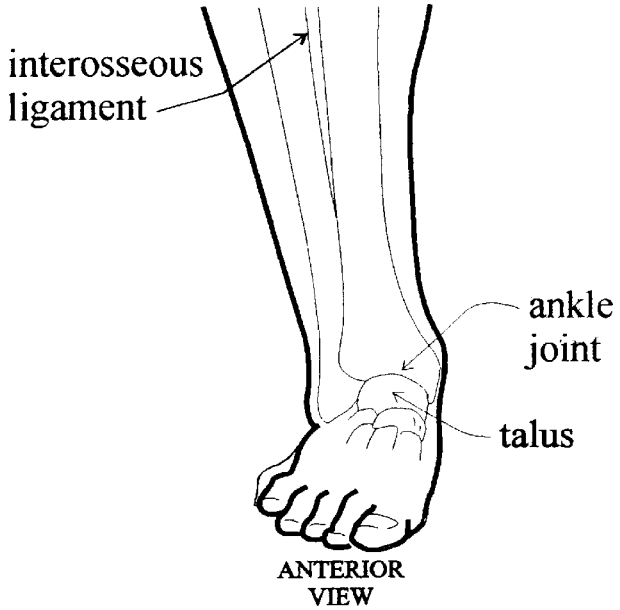
FIG. 10 is an anterior view of a foot.
Figure 11:
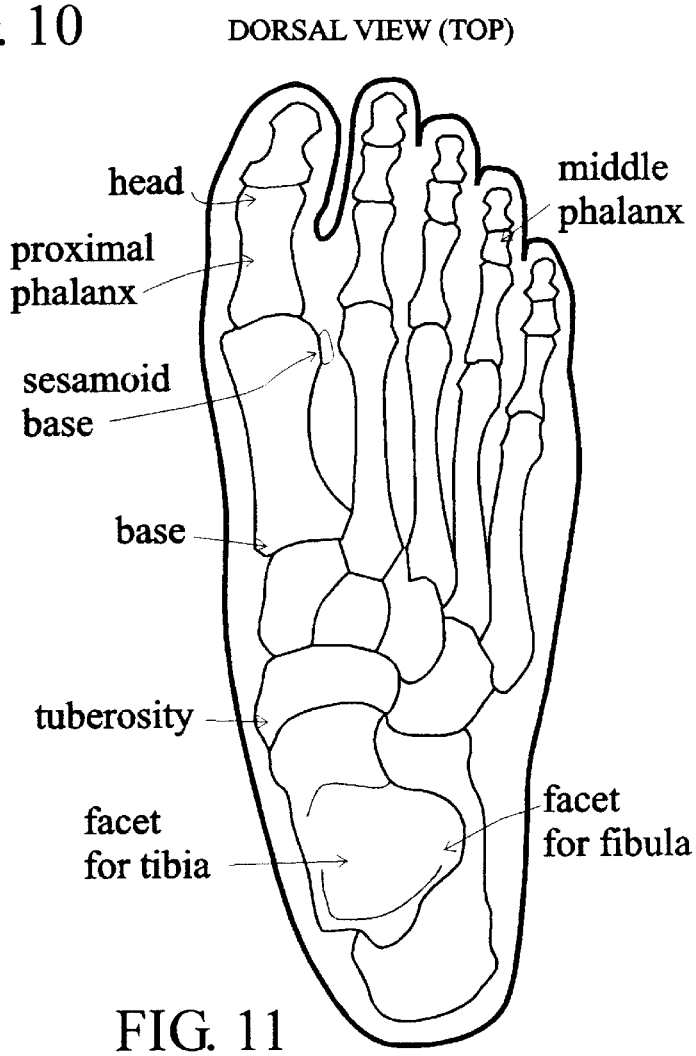
FIG. 11 is a dorsal view of a foot illustrating the bone structure of the foot.
Figure 12A:
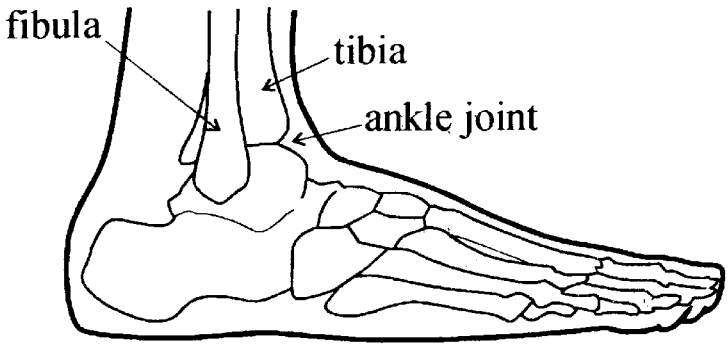
FIG. 12A is a lateral view of a foot.
Figure 12B:
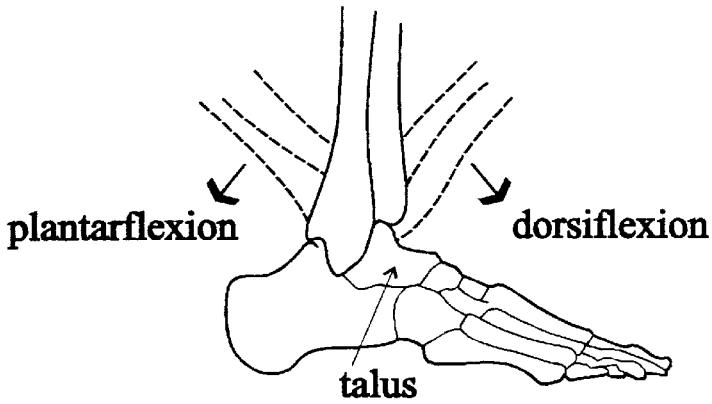
FIG. 12B is a lateral view of a foot illustrating ankle movement.
Figure 12C:
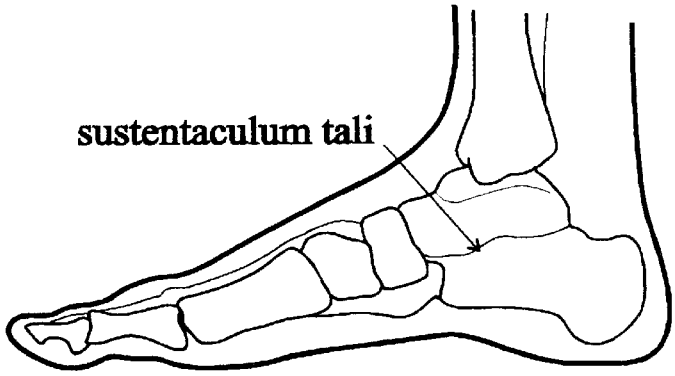
FIG. 12C is a medial view of a foot.

Referring to FIG. 9, the angle of recovery of a standard shoe design A1, A2 is typically around 15°. However, with the extended sole, the angle of recovery of shoe 10 of the present invention is significantly increased, for example in range of 20° to 30°, more typically in a range of 30° to 40° and, most typically about 45°. By way of reference to FIG. 8, when a person wearing a conventional shoe leans, for example to the left as shown in FIG. 8, the reaction force from the ankle (labeled F2 in FIG. 8) is offset from the reaction force on the shoe (labeled F1); thus, a moment is created within the ankle joint. However, an overturning moment is only created when a force of great enough magnitude is placed upon the ankle joint at an angle great enough to overcome the inherent stability properties of the shoe. Therefore, with an increased recovery angle for the shoe, the likelihood of creating an overturning moment within the ankle joint of a user wearing shoe 10 is drastically reduced. The combined effect of the sole and the suspension system of the present invention is to provide correction, if not for most, probable scenarios involving the ankle joint and the inherent forces involved when landing, twisting, turning, and/or rolling, or the like.

An unrecoverable force to the ankle joint takes place when the force angle meets or exceeds the recovery angle of the shoe. When this occurs, extension of the force applied to the shoe intersects the ankle joint on the opposite side of the ankle joint from which the force originated; thus, creating an overturning moment within the ankle joint. This overturning moment results in the rolling of the ankle joints either as inversion or, more likely, eversion movement that generally leads to a sprain of the ankle joint. As viewed in FIG. 6, by creating a wider sole (12), the sole creates a large enough angle of recovery within the shoe and ankle joint relationship so as to provide as practically as possible a condition where all forces applied to the sole of the shoe will be at an angle less than the angle of natural recovery for the shoe and the ankle joint relationship. Furthermore, all forces that would be applied to the shoe at an angle greater than the angle of recovery of forces when the person wearing the shoe is most likely to fall down rather than attempt to use the ankle to stand and apply a resistance force; thus, effectively eliminating any potential ankle sprain and injury. Because the angle of recovery varies greatly and is effected by the dynamics of the type of forces, the magnitude of forces, and the ankle forces that different sports tend to impose on the ankle joint, the foot print of sole 12 can be varied. Activities such running, jogging, or walking do not tend to require as high of an angle of recovery as 45° noted above, due to the fact that these activities do not tend to demand as high a level of lateral movement or forces upon the ankle joint.

Figure 13A:
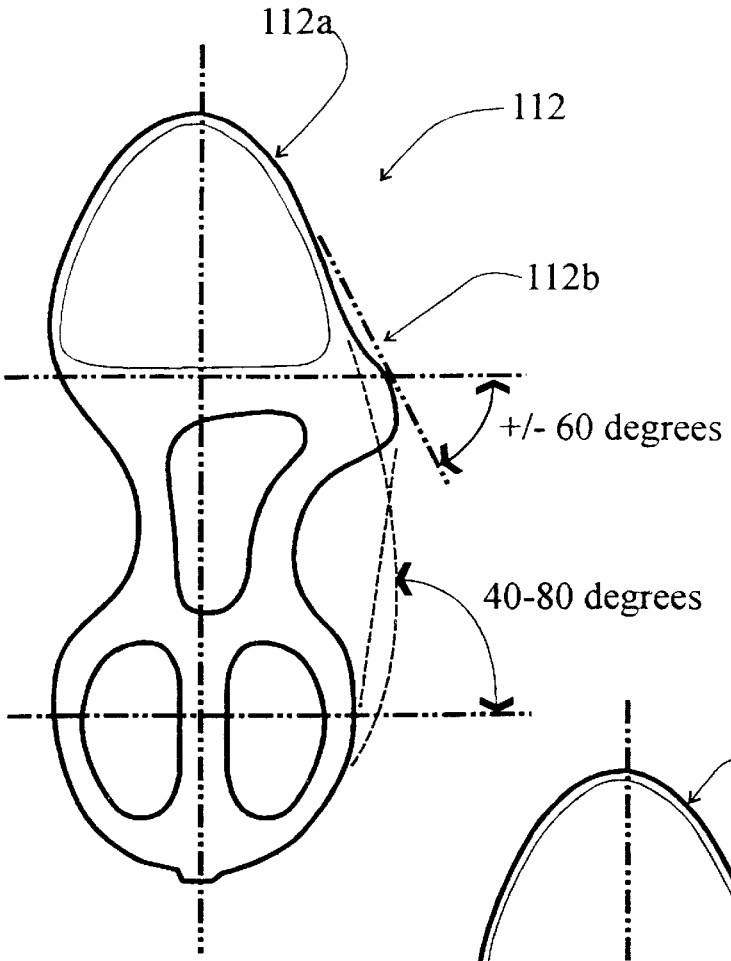
FIG. 13A is a plan view of a second embodiment of a sole of the footwear illustrated in FIG. 1.

For example, referring to FIG. 13A, sole 112 includes a front portion 112*a* which generally follows the foot print of the Phalanges region of the foot, and a localized increased area or extended portion 112*b* that extends laterally outward from central longitudinal axis 112*c* of sole 112 approximately at the fifth Metatarsal and Proximal Phalanx. Extended portion 112*b* provides an optimal return stabilizing force to a potential forward rolling sprain in a direction from the ankle centroid in a direction of the fifth Metatarsal and Proximal Phalanx.

Figure 13B:
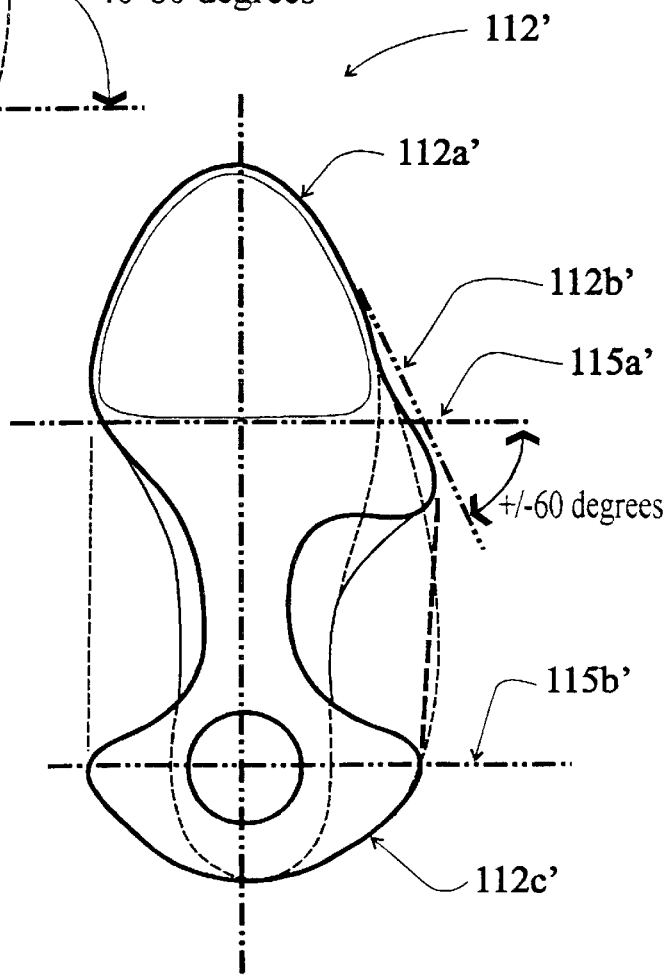
FIG. 13B is a plan view of a third embodiment of a sole of the footwear of FIG. 1.

Referring to FIG. 13B, another embodiment of sole 112' of the present invention is illustrated. Sole 112' includes a forward portion 112*a'* and a rearward or posterior portion 112*c'*. Forward portion 112*a'* includes an enlarged area or lateral extent 112*b'* rearward of the lateral axis 115*a* which extends through the toe region of the wearer of the shoe at or approximately near the fifth Metatarsal and Proximal Phalanx similar to sole 112. In addition, posterior portion 112*c'* is widened on both the lateral and medial sides of sole 112 along line 115*b*, which extends laterally through the centroid of the ankle joint.

Figure 5B:
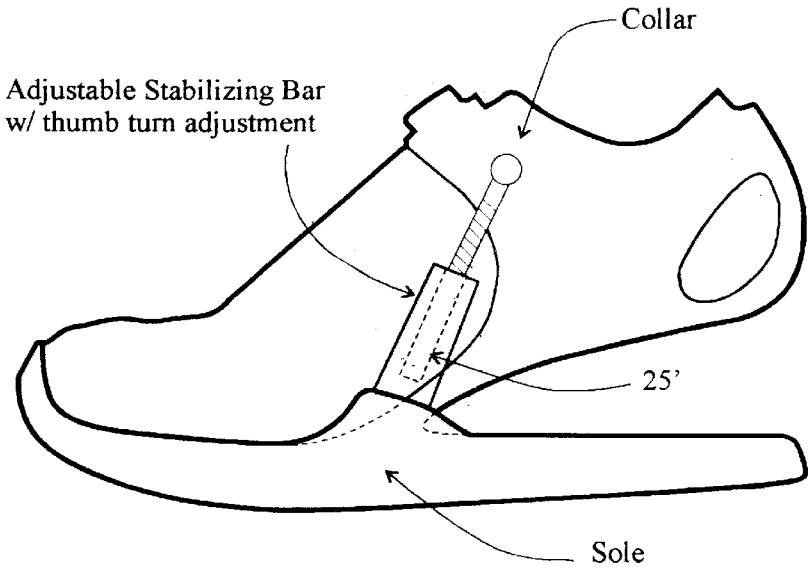
FIG. 5B is a lateral side view of a shoe of the present invention incorporating an adjustable stabilizing bar.
Figure 5C:
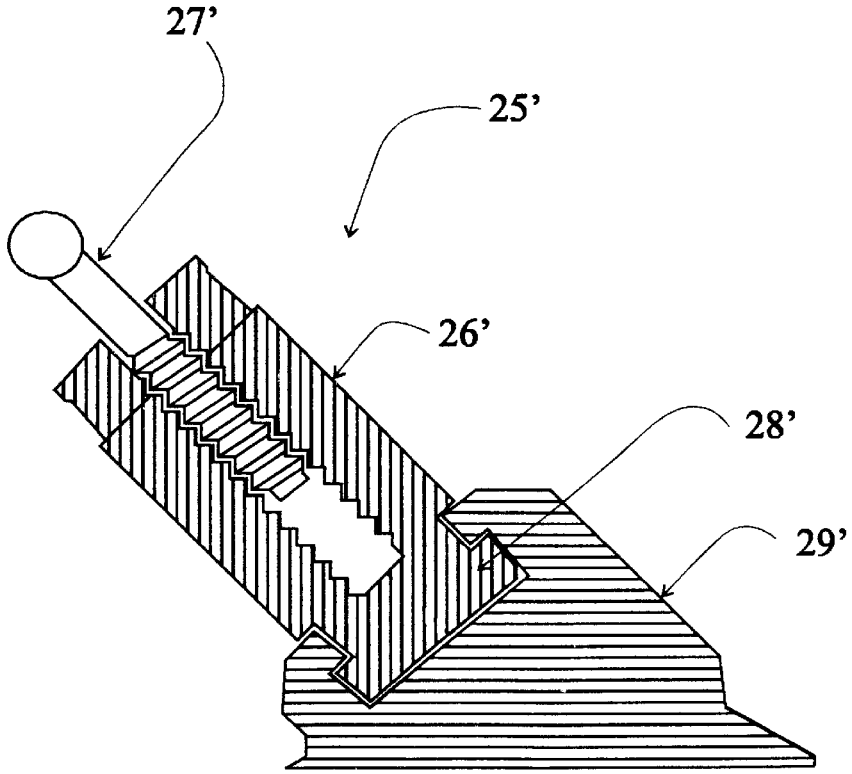
FIG. 5C is an enlarged cross-section of the stabilizing bar of FIG. 5B.
Figure 5D:
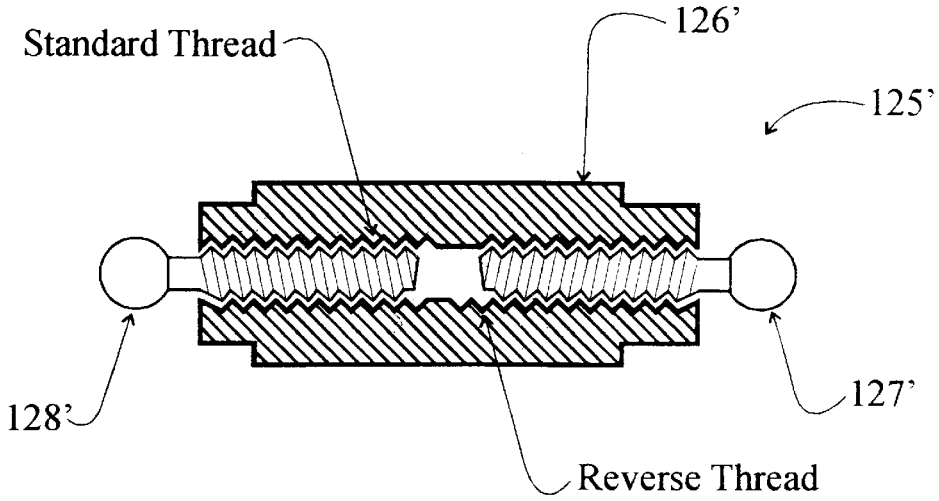
FIG. 5D is an enlarged cross-section view of another embodiment of a stabilizing bar.

Referring to FIGS. 5B–5D, the stabilizing bars of the shoe of the present invention may comprise adjustable stabilizing bars 25' or 125'. Referring to FIGS. 5B and 5C, adjustable stabilizing bar 25' includes a threaded sleeve 26' and a single pin 27'. Pin 27' includes a threaded shaft that extends into sleeve 26' and a head which attaches to the shoe, for example, at the collar. Sleeve 26' includes an anchor flange 28', which is rotatably mounted or embedded in the sole of the shoe, for example in an abutment 29'. In this manner, when sleeve 26' is rotated, pin 27' either retracts into or moves out of sleeve 26' to adjust the length of the stabilizing bar.

Referring to FIG. 5C, stabilizing bar 125' includes a threaded sleeve 126' and a pair of threaded attachment pins or screws 127' and 128'. Sleeve 126' and pins 127', 128' may be plastic or metal. Pin 127' is attached or is anchored to the sole while pin 128' is attached or anchored to the collar. In addition, pins 127' and 128' include reverse threaded shafts that extend into sleeve 126' so that when sleeve 126' is rotated about pins 127' and 128', pins 127' and 128' either retract together into sleeve 126' or move outwardly from sleeve 126'. In this manner, a wearer of the shoe may simply rotate sleeve 126' to adjust the length of the stabilizing bar. The ability to lengthen/shorten the stabilizing bar will allow the user to customize the fit of the shoe by raising or lowering the amount of pressure that the stabilizing bar exerts on the collar, and into the ankle joint. The stabilizing bar would be adjusted in length by hand turning the middle section in one direction to lengthen, and in the opposite direction to shorten.

Figure 5F:
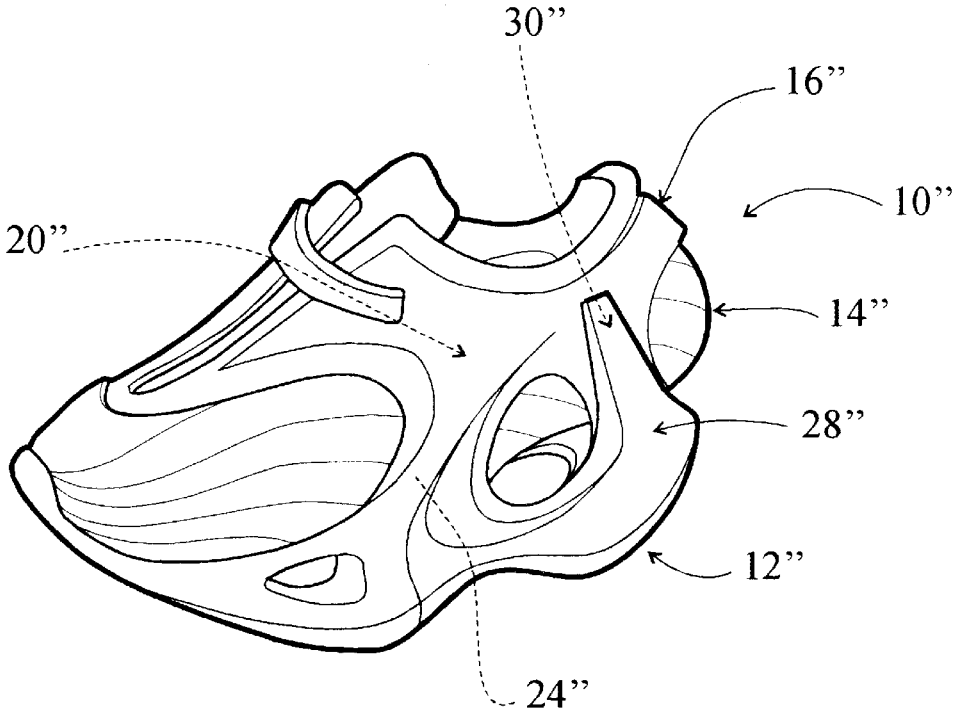
FIG. 5F is a view similar to FIG. 5 illustrating another embodiment of the foot wearer of the present invention.
Figure 5E:
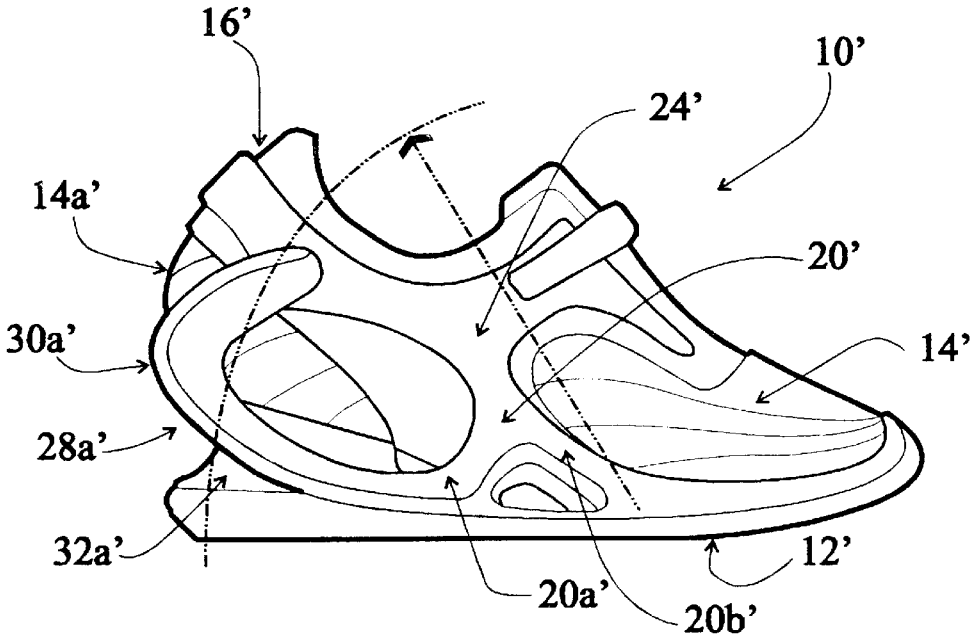
FIG. 5E is a top perspective view of another embodiment of the footwear of the present invention.

Referring to FIG. 5E, foot wearer 10' of the present invention may incorporate a reverse springs 28' and 30*a'*, which extend down from at or near collar 16' to sole 12' similar to springs 28 and 30 but in a reverse curve direction. Shoe 10 similarly includes an inversion and eversion stabilizing bars 20' and 24' which extend from collar 16' to sole 12'. In the illustrated embodiment, stabilizing bar 20' includes a pair of leg portions 20*a'* and 20*b'* which connect to sole 12' at spaced locations. Furthermore, in the illustrated embodiment, springs 28*a'* and 30*a'* are integrally formed with stabilizer bars 20' and 24' and, further, with collar 16' and sole 12'. In this manner, shell 14' is mounted to the combined unit comprising springs 28', 38*a'*, stabilizing bars 20', 24', and sole 12'. Furthermore, heel area 14*a'* of shell 14' is suspended above sole 12' by a cushioning element 32'. In the illustrated embodiment, cushioning element 32' comprises a cylindrical shaped member. In addition, as previously described in reference to cushioning element 32, cushioning element 32' may comprise a fluid filled container, which includes a valve that permits adjustment of the pressure in cushioning element 32' to adjust the resistance of cushioning element 32'. Sole 12' may incorporate the foot print illustrated in reference to the previous embodiments and, further, the various foot prints described in reference to the later embodiments.

The adjustable stabilizing bar will allow the user to slightly alter the lateral force generation of both the medial and lateral sides by the use of a stabilizing bar located on one or both sides of the foot. User ways in which to adjust the length of the stabilizing bar could be mechanical unfastening and adjusting the length of the bar, then refastening of the "binding".

Referring to FIG. 5F, foot wearer 10" includes a sole 12" and a shell 14" similar to the previous embodiments. In addition, foot wearer 10" includes a pair of stabilizing bars 24" and 20" similar to the previous embodiment. In contrast to the spring provided in the previous embodiments, shoe 10" includes a pair of rear struts or supports 28" and 30" which extend from collar 16" to sole 12". In contrast to the springs, supports 28" and 30" provide rigid support to the shell and collar. Similar to the springs, supports 28" and 30" provide the lateral support which minimizes the risk of ankle sprain or injury by transferring the reaction forces at the sole to counteracting lateral forces which are at least generally aligned with the centroid of the ankle of the wearer of shoe 10". Again, as previously noted in reference to the previous embodiment, supports 28", 30", and stabilizing bars 20' and 24' and sole 12" may be combined as a single piece or unit in which shell 14" is supported. In addition, optionally, shoe 10" may incorporate a cushioning element beneath the heel portion of shell 14" similar to the previous embodiments.

Figure 14:
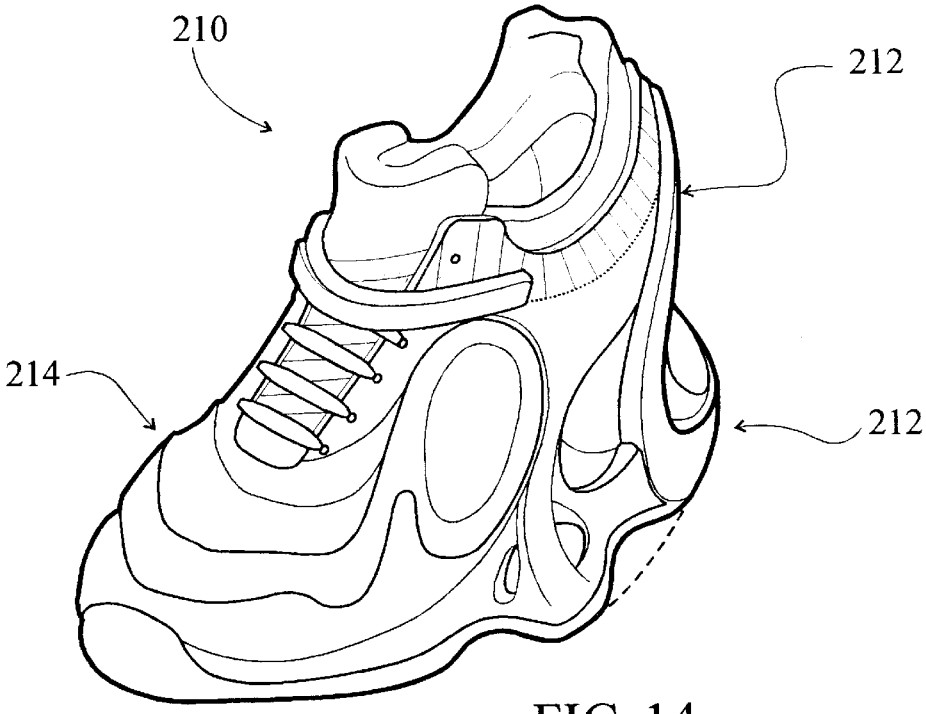
FIG. 14 is a top perspective view of a second embodiment of the footwear of the present invention.
Figure 15:
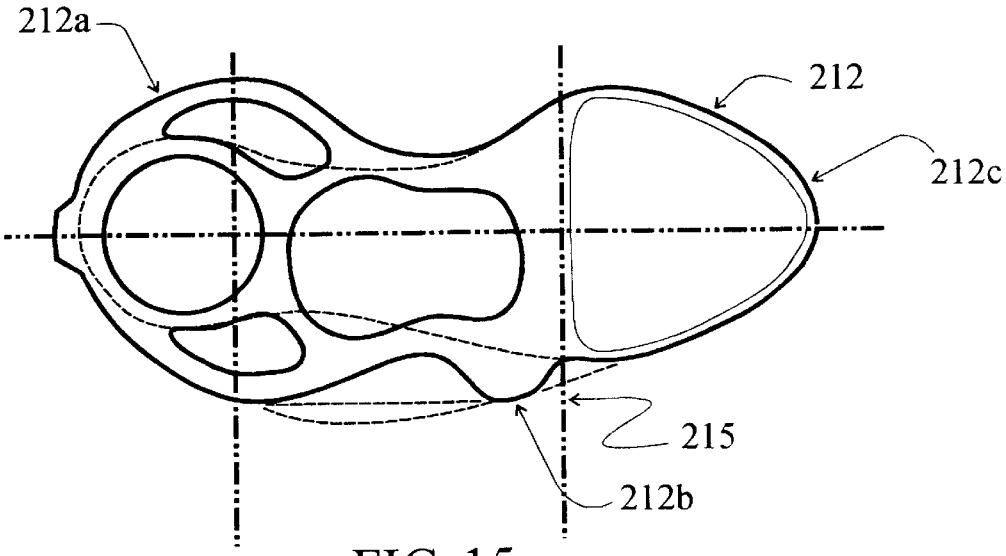
FIG. 15 is a bottom plan view of the shoe of FIG. 14.

Referring to FIGS. 14 and 15, shoe 210 is of similar construction to shoe 10 and includes a sole 212 and an upper portion 214. In the illustrated embodiment, sole 212 includes an enlarged posterior end 212*a* and an enlarged lateral portion 212*b*. Anterior portion 212*c* generally follows the shape of the anterior portion of the foot at least over the phalanges region with enlarged lateral portion 212*b* being located slightly rearward of the lateral axis 215 that extends through the fifth Metatarsal and Proximal Phalanx. In this manner, sole 212 provides an enlarged angle of recovery similar to sole 12 and, further, provides an optimal return stabilizing force to a potential forward rolling motion in the direction of the fifth metatarsal and proximal phalanx similar to sole 112.

Figure 16:
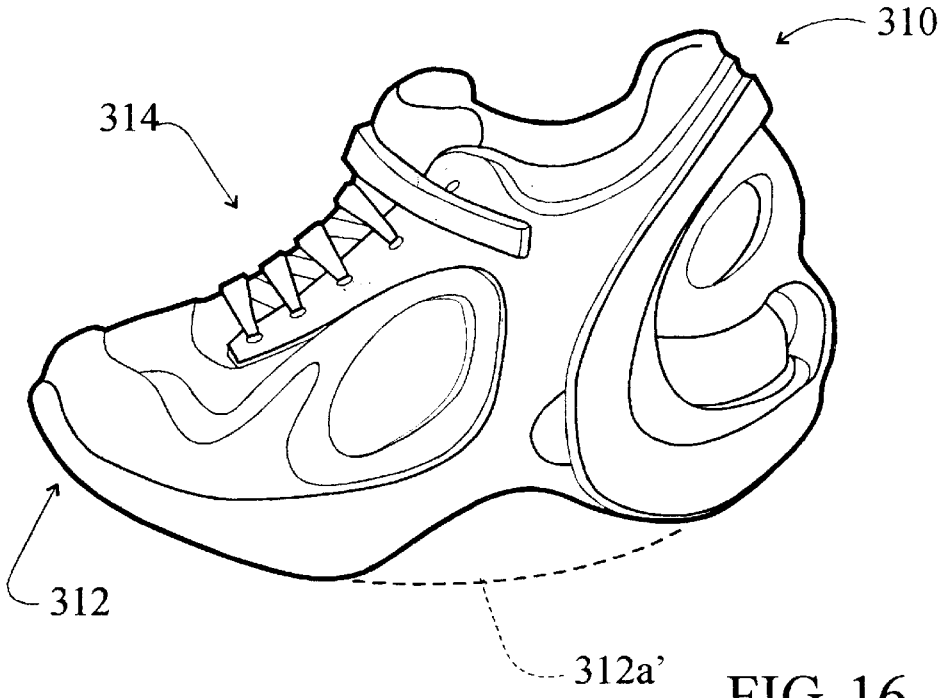
FIG. 16 is a lateral side view of another embodiment of the footwear of the present invention.
Figure 17:
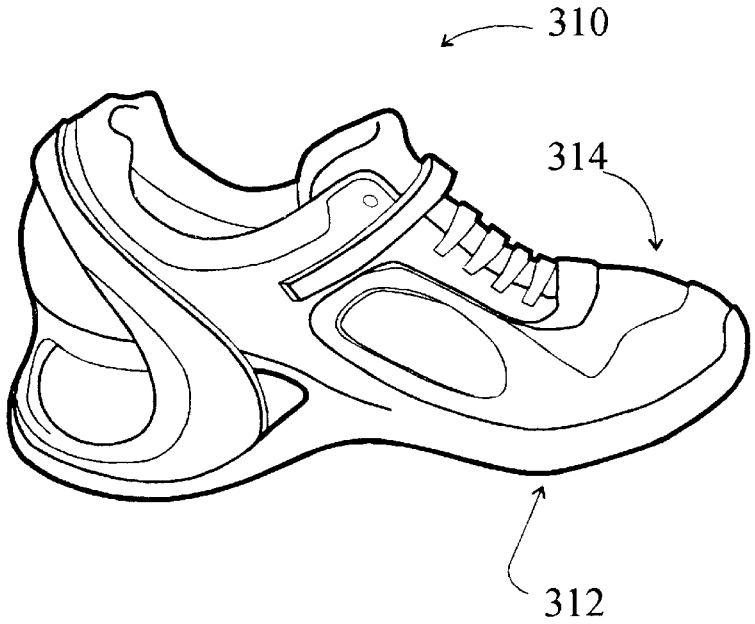
FIG. 17 is a medial side view of the shoe of FIG. 16.
Figure 18:
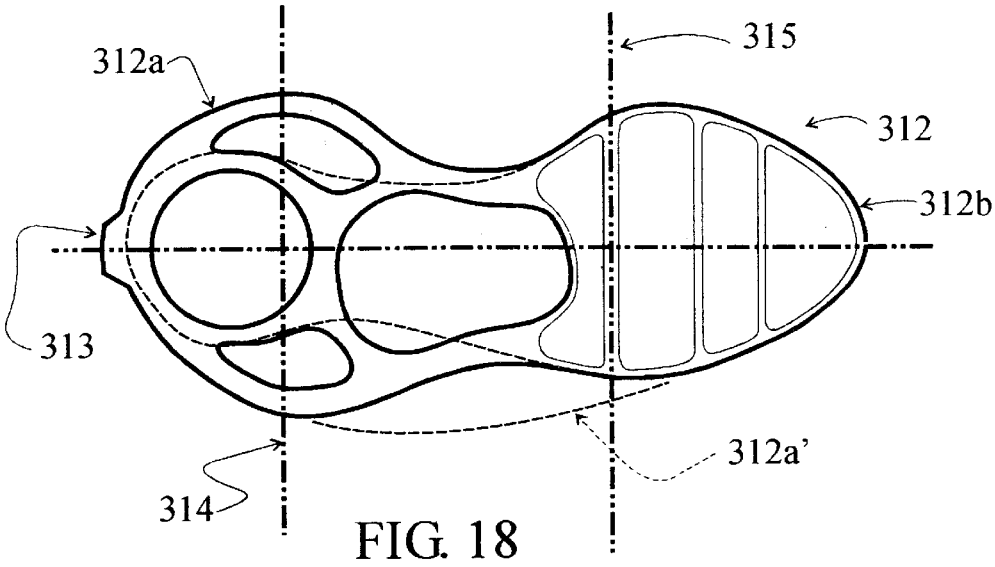
FIG. 18 is a bottom plan view of the shoe of FIG. 17.

Referring to FIGS. 16–18, shoe 310, which is also similar to shoe 10, includes a sole 312 and an upper portion 314 which incorporates the suspension system described in reference to the first embodiment. Though it should be understood that shoe 310 may incorporate any one or a combination of the suspension systems described previously or described in reference to the proceeding embodiments. Referring to FIG. 18, in the illustrated embodiment, sole 312 includes an enlarged posterior portion 312*a*. Forward portion 312*b* of sole 312 generally follows the contour of the foot of the wearer. Enlarged posterior portion 312*a* extends from the rearmost portion 313 of sole 312 and returns inwardly at or near the axis 314 which extends laterally through the centroid of the ankle of the wearer of shoe 310. In this manner, sole 312 has its largest recovery angle through the centroid of the ankle of the wearer. Optionally, as shown in the dotted line, 312*a*' enlarged portion may continue to project outwardly from sole 312 and connect to forward portion 312*b* at or near the lateral axis which extends through the fifth Metatarsal in Proximal Phalanx to thereby provide additional lateral stability resistance to a potential forward rolling sprain.

Figure 19:
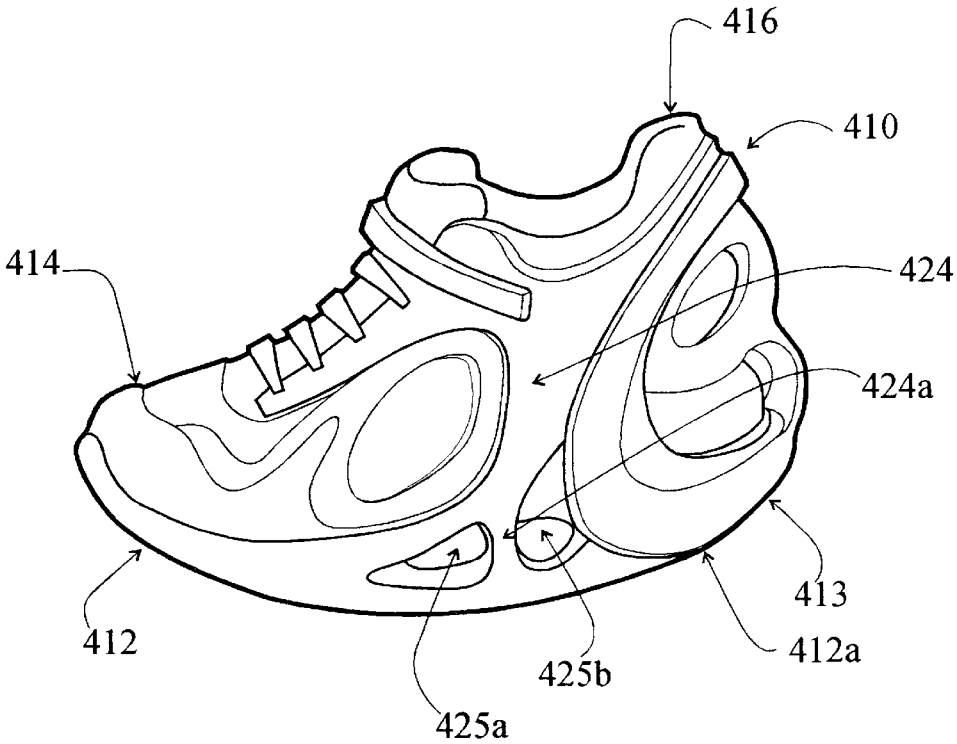
FIG. 19 is a perspective view of another embodiment of the footwear of the present invention.

Referring to FIG. 19, shoe 410 includes a sole 412 and upper portion 414 similar to the previous embodiment. However, sole 412 includes the extended widened portion 412*a*, which extends from the posterior end of the sole 412 to the lateral axis which passes through the fifth Metatarsal and Proximal Phalanx.

In the illustrated embodiment, upper portion 414 includes a lateral longitudinal arch support 424 which extends from collar 416 to sole 412 similar to arch support 24 of shoe 10. However, in the illustrated embodiment, arch support 414 forms a finger 424*a* which extends between upper portion 414 and sole 412 and defines openings 425*a* and 425*b* on either side to reduce the weight of shoe 10.

Figure 20:
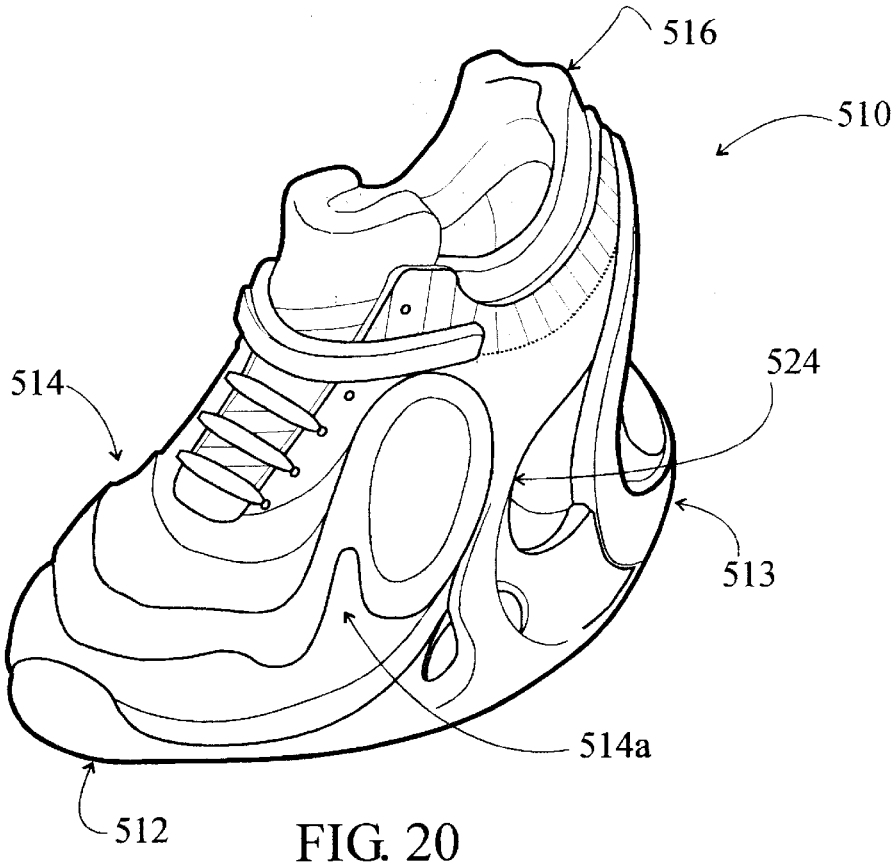
FIG. 20 is a top perspective view of another embodiment of the footwear of the present invention.

Referring to FIG. 20, shoe 510 includes an upper portion 514 and a sole 512 similar to the previous embodiment and, further, a suspension system, similar to that described in reference to the first embodiment. Shoe 510 is of similar construction to shoe 410, with sole 512 including a widened portion, which extends from the posterior end 513 of shoe 510 and which extends to the lateral axis that passes through the fifth metatarsal and proximate phalanx similar to sole 412. Upper portion 514 includes a collar 516 and a lateral longitudinal arch support 524 which joins with sole 512 laterally outward from the shell 514*a* of upper portion 514.

Figure 21:
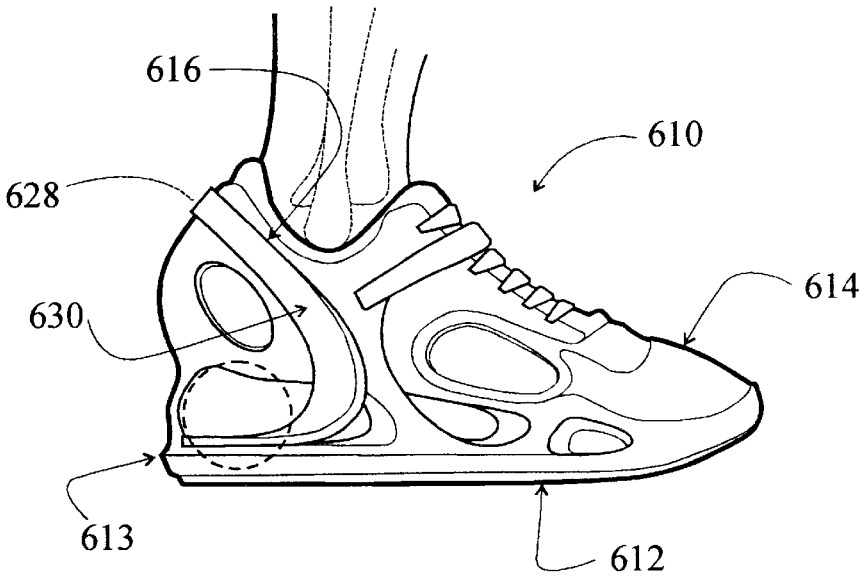
FIG. 21 is a lateral side view of another embodiment of the footwear of the present invention.

Referring to FIG. 21, shoe 610 includes a sole 612 and an upper portion 614 similar to shoe 10. Shoe 610 has a similar suspension system to shoe 10; however, eversion spring 630 and inversion spring 628 do not extend fully around the posterior portion 613 of sole 612 and instead terminate forward of posterior portion 613. Similar to the previous embodiments, however, inversion and eversion springs 628, 630 extend up to and attach to upper portion 614 at or near collar 616 to thereby transfer the reaction forces at the edge of sole 612 to the top of shoe 10 to in effect suspend the ankle and further transfers these forces to the centroid of the wearer's ankle joint.

Figure 22:
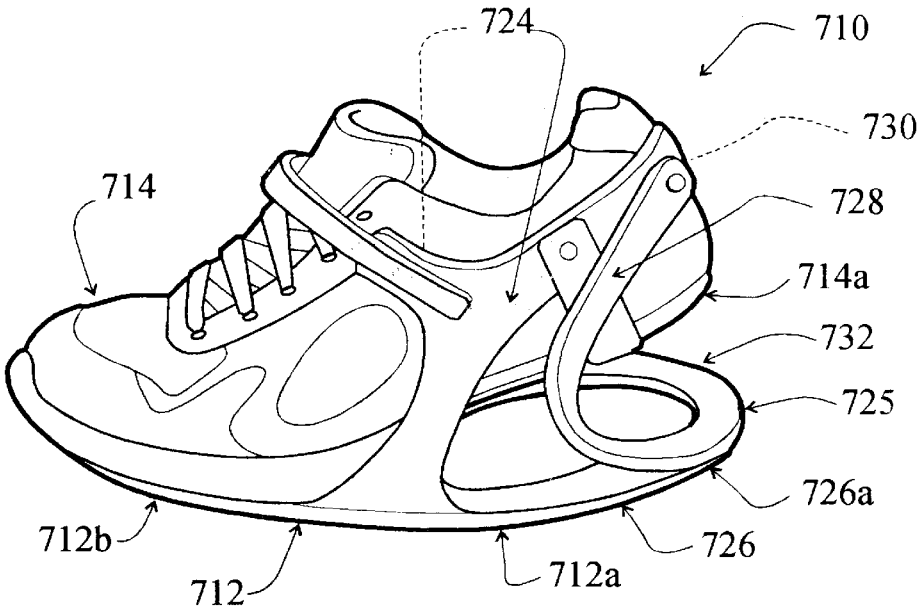
FIG. 22 is a side view of another embodiment of the footwear of the present invention.

Referring to FIG. 22, shoe 710 includes a separate frame 725, which includes inversion spring 728 and eversion spring 730. Furthermore, frame 725 includes a stirrup 732, which extends under the heel portion 714*a* of the upper portion 714 of shoe 710. Springs 728, 730 and stirrup 732 secure to upper portion 714, for example by fasteners, and, more preferably by removable fasteners to permit replacement or substitution of frame 725. In addition, frame 725 includes a base 726 which aligns with and forms a posterior sole portion 712*a*. Posterior sole portion 712*a* aligns with a forward sole portion 712*b* to form sole 712 of shoe 710. Posterior portion 726*a* of base 726 preferably comprises an enlarged or widened base to increase the angle of recovery of shoe 710, as described in reference to the previous embodiments. In addition, frame 725 incorporates a lateral longitudinal arch support 724 and a medial longitudinal arch support 722 similar to shoe 10. Thus, upper portion 714 is removably mounted in frame 725. In this manner, frame 725 can be removed and replaced or substituted, as desired, for a frame with a different suspension system to accommodate the wearer's individual needs. Similar to the previous embodiments, shoe 710 may incorporate a cushioning element that is positionable between the heel portion 714*a* of upper portion 714 and posterior portion 726*a* of base 726.

Figure 23:
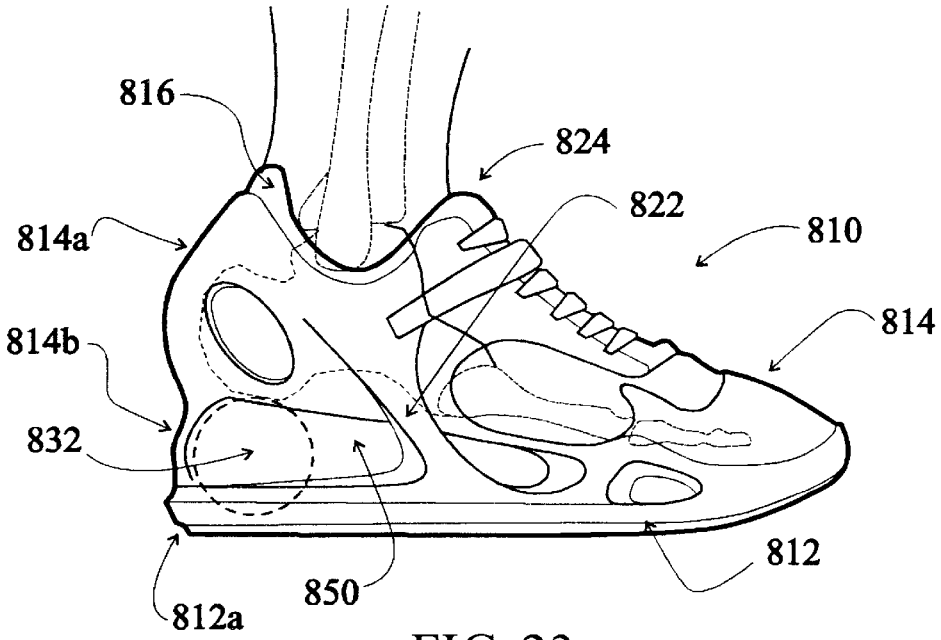
FIG. 23 is a lateral side view of another embodiment of the footwear of the present invention.

Referring to FIG. 23, shoe 810 includes a sole 812 and an upper portion 814. Posterior portion 814*a* of upper portion 814 is suspended above posterior portion 812*a* of sole 812 by a cushioning element 832. Posterior portion 814*a* includes a downwardly extending web 814*b*, which interconnects upper portion 814 and sole 812 to limit the extension between upper portion 814 and sole 812 and, further, to provide a means to retain cushion element 832 in cavity 850, which is defined between upper portion 814 and sole 812. Similar to the previous embodiments, upper portion 814 includes arch supports 822 and 824, which extend from upper portion and preferably collar 816 to sole 812. In addition to providing lateral support to the ankle of the wearer, arch supports 822 and 824 distribute the forces from the edges of sole 812 to the top of upper portion 814. The resistance of arch supports 822 and 824 may be increased to compensate for the omitted inversion and eversion springs incorporated into the previous embodiments. However, it should be understood that, shoe 810 may incorporate eversion and inversion springs as well.

Figure 24:
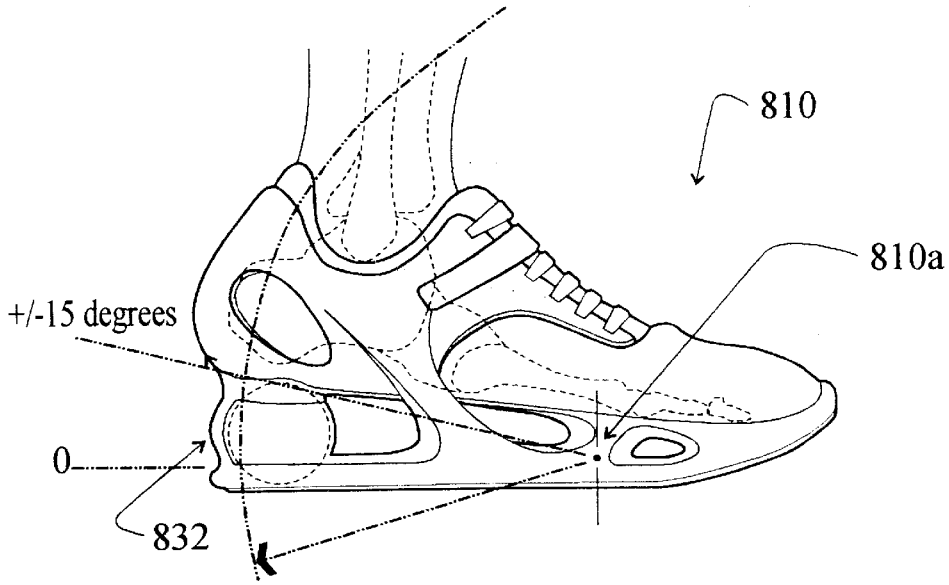
FIG. 24 is a lateral side view of another embodiment of the footwear of the present invention illustrating the point of access of rotation of the shoe.

Referring to FIG. 24, shoe 810 pivots about pivot access 810*a*, which is coincident with the lateral axis that passes through foot at or in close proximity to the fifth Metatarsal and Proximal Phalanx, similar to the previous embodiments. Though illustrated as a spherical cushioning and energy storage element, cushioning energy storage element 832 may comprise other shapes, such as disclosed in reference to shoes 910 and 1010 described below (but not limited to).

Figure 25:
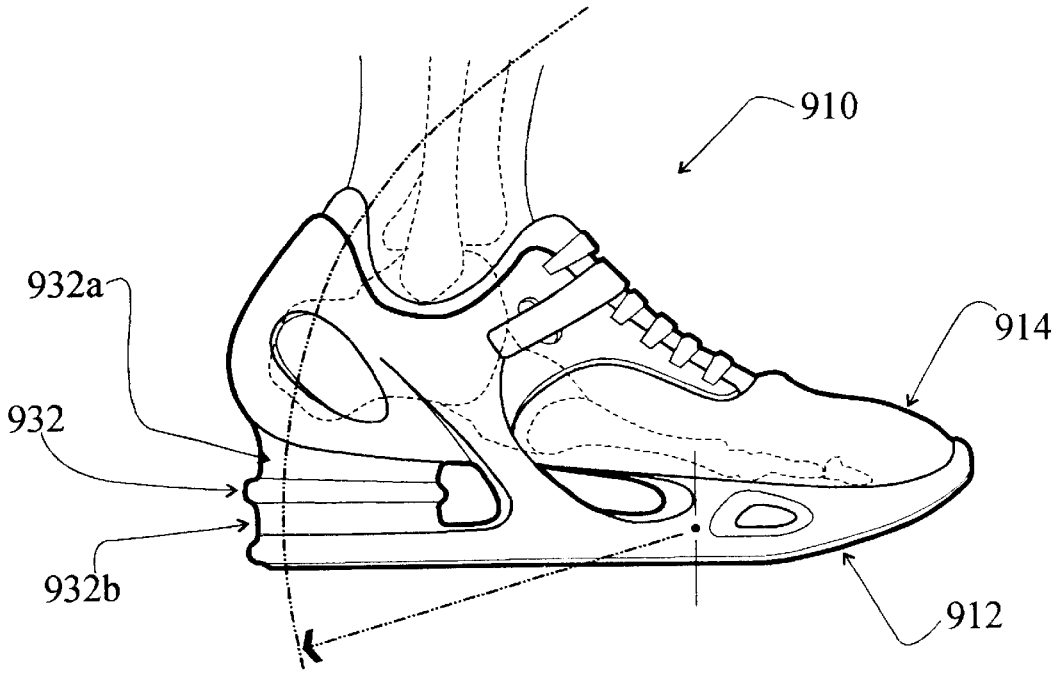
FIG. 25 is a side elevation view of another embodiment of the footwear of the present invention illustrating the hinge point of the footwear.

Referring to FIG. 25, shoe 910 includes a sole 912 and an upper portion 914 similar to shoe 810. In the illustrated embodiment, cushioning element 932 includes a pair of chambers 932*a* and 932*b*, which may be pressurized differently. For example, upper chamber 932*a* may be pressurized with a lower pressure than chamber 932*b* so that the initial impact forces generated by the foot of the wearer will initially compress chamber 932*a*. When chamber 932*a* is compressed and deflected such that the pressure in chamber 932*a* equals the pressure in chamber 932*b*, both chambers 932*a* and 932*b* will compress. In the illustrated embodiment, cushioning element 932 is integrally formed with sole 912 and upper portion 914. In addition, cushioning element 932 may incorporate more than two chambers with each chamber optionally having a different pressure.

Figure 26:
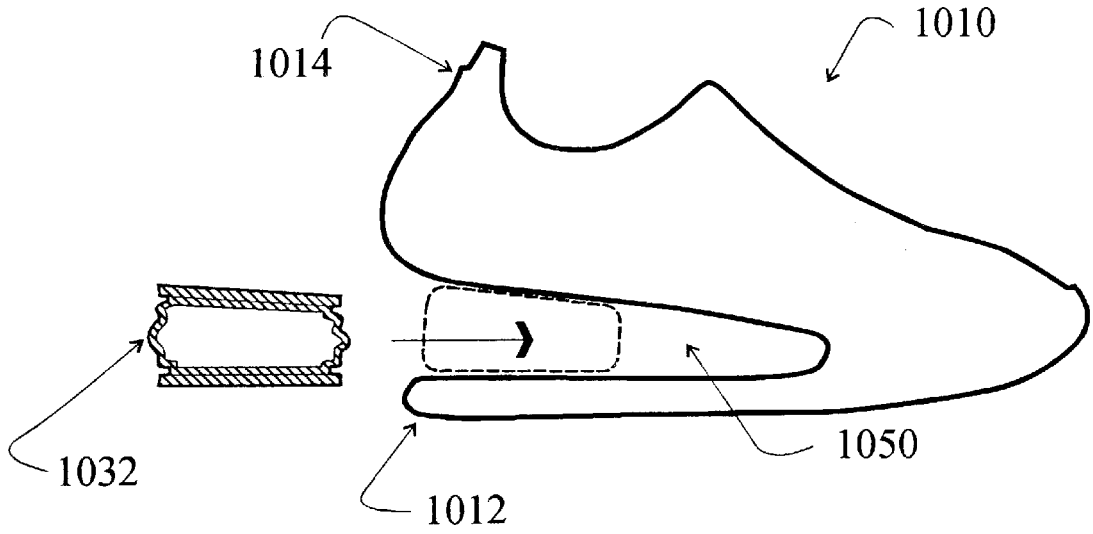
FIG. 26 is a schematic view of the shoe of FIG. 27.
Figure 27:
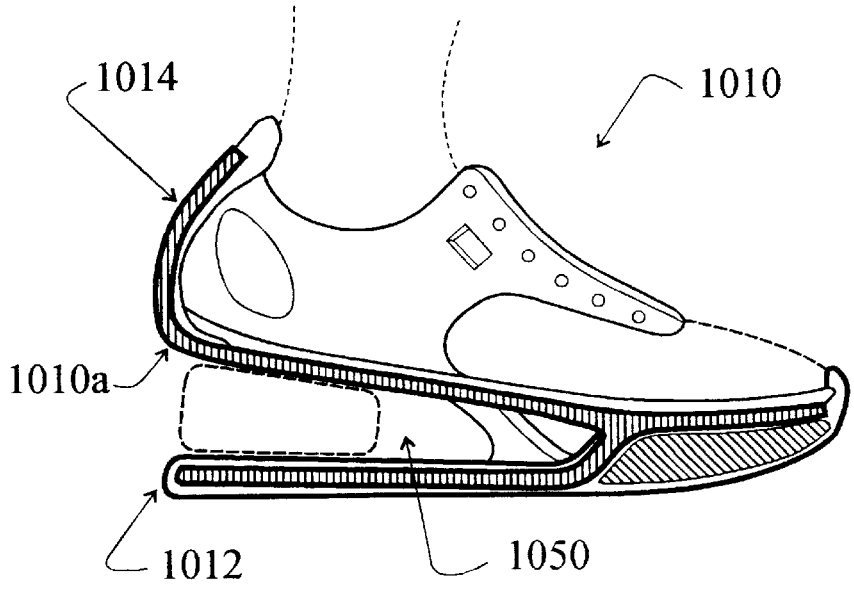
FIG. 27 is a cross-section view of another embodiment of the shoe of the present invention.

However, referring to FIGS. 26 and 27, cushioning elements, such as cushioning element 1032 of shoe 1010, may be removably mounted in cavity 1050 so that shoe 1010 can be customized to suit the wearer's needs. For example, cushioning element 1032 may be inserted from the posterior end 1010*a* of shoe 1010 between the upper portion 1014 and sole 1012.

Figure 28:
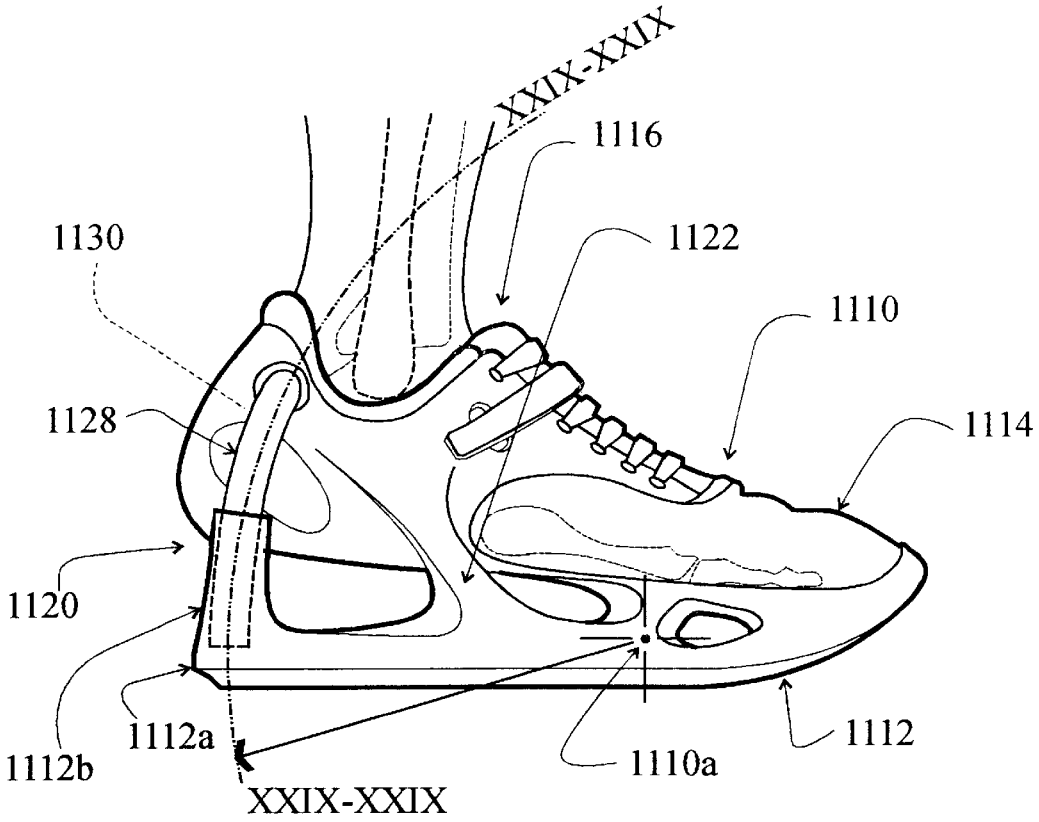
FIG. 28 is a front perspective view of another embodiment of the footwear of the present invention.
Figure 29:
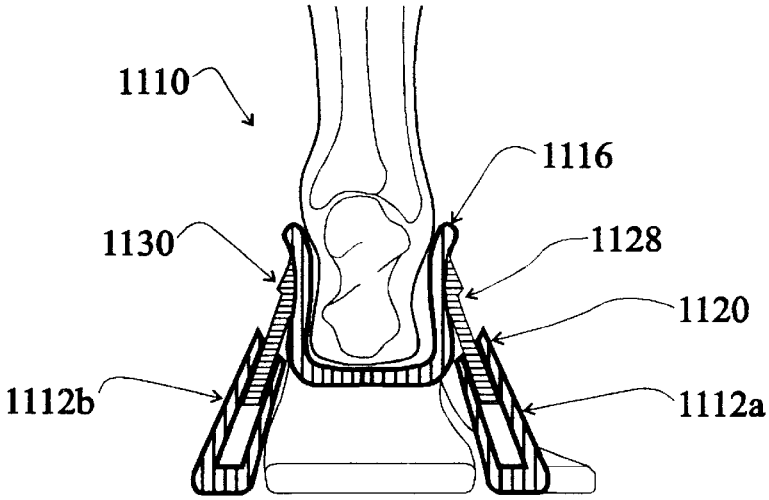
FIG. 29 is a cross-section view taken along line XXIX—XXIX of FIG. 28.

Referring to FIG. 28, shoe 1110 includes a sole 1112 and an upper portion 1114 similar to shoe 810. Upper portion includes a collar 1116 and a medial arch support 1122, which extends from the collar 1116 of upper portion 1114 to sole 1112. In the illustrated embodiment, shoe 1110 includes a suspension system 1120 that includes a pair of springs; namely an inversion spring 1128 and an eversion spring 1130. In the illustrated embodiment, springs 1128, 1130 are fixedly secured to upper portion 1114 on one end, preferably at or near collar 1116, and movably connected to sole 1112 at their opposed ends. For example, springs 1128, 1130 may include a slip connection with the receiving portion 1112*a* and 1112*b* of sole 1112. In this manner, springs 1128, 1130 flex more freely, thereby allowing for a maximum amount of cushioning and energy recovery in the spring (stored energy and release thereof) of the forces transferred from the heel of the foot into shoe 1110. Optionally, springs 1128 and 1130 are provided by a pair of compression cylinders. As noted in reference to the previous embodiments, shoe 1110 includes a pivot axis 1110*a* about which shoe 1110 flexes when a forward motion is exhibited. In one form, springs 1128, 1130 are aligned along the arc of the path of rotation of shoe 1110 about pivot axis 1110*a* to avoid generating undesirable restraining forces.

Figure 29A:
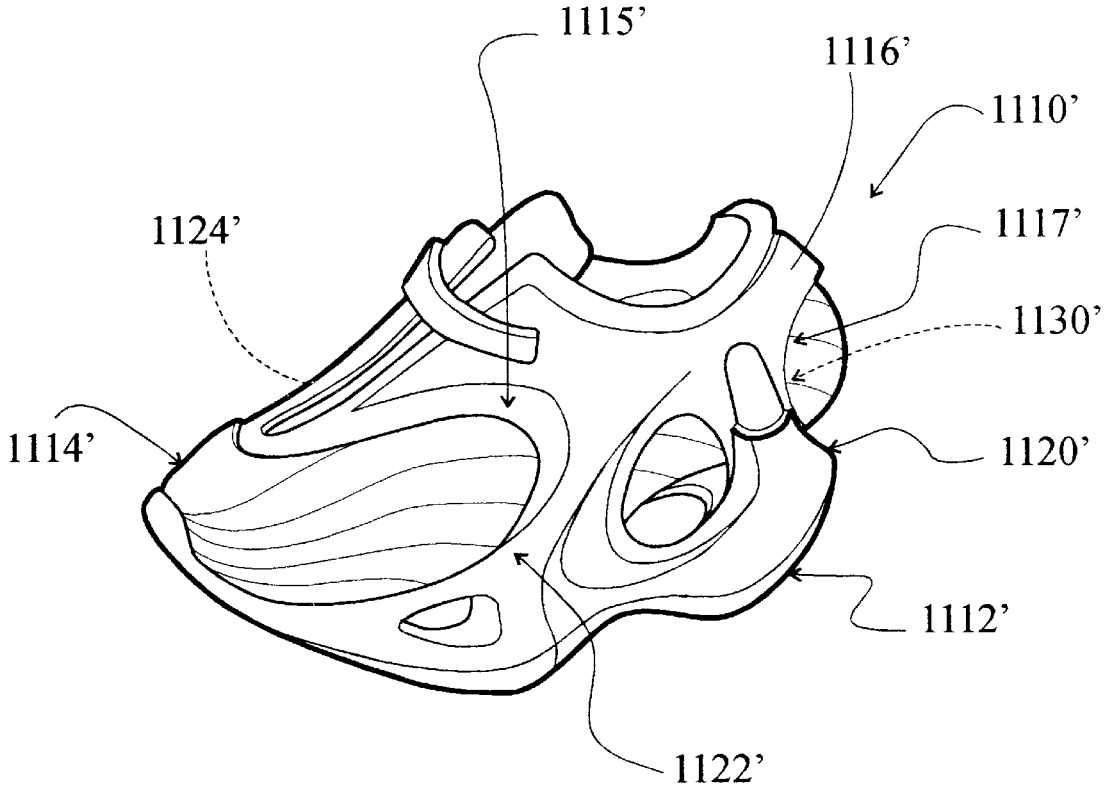
FIG. 29A is a top perspective view of another embodiment of the foot wearer of the present invention.

Referring to FIG. 29*a*, shoe 1110' illustrates another embodiment of a footwear of the present invention incorporating medial and lateral support, such as compression cylinders 1120' and 1130'. In addition, foot wearer 1110' incorporates a pair of stabilizing bars 1122" and 1124" similar to the stabilizing bars in shoe 10' and 410, for example. In the illustrated embodiment, medial and lateral supports 1120' and 1130', stabilizing supports 1122' and 1124', collar 1116', and sole 1112' are provided as a unit with shell 1114' supported by a pair of downwardly extending stirrups or saddles 1115', 1117', which extend downwardly from the unit, for example, from collar 1116'. Similar to the previous embodiments, medial and lateral supports 1120' and 1130' comprise compression cylinders and preferably adjustable compression cylinders so that a wearer of foot wearer 1110' may adjust the resistance of medial and lateral supports 1120' and 1130'.

It should be understood from the foregoing, that the shoe of the present invention incorporates a suspension system that lowers the center of gravity of the ankle joint by raising the bearing level of the foot to the level of the ankle joint. Furthermore, the suspension system permits unrestricted or unencumbered movement of the ankle joint in the desired plane of rotation that is the Flexion/Dorsi Plane (heel/toe). Furthermore, the various soles of the shoe of the present invention increase the angle of recovery of the shoe and, therefore, minimize the risk of strain to the ankle. By providing various stability zones in the sole, the inversion/eversion angle of recovery can be increased, for example up to 45°. The angle of recovery of the forward roll of the shoe is also optimally increased, for example up to 60°.In this manner, the angle at which the foot of the wearer must reach (before creating an overturning moment) is so large that the angle is more likely to cause the wearer of the shoe to fall down rather than induce an ankle sprain and injury. In addition, the combination of the inversion and eversion springs, which act like leaf springs, with the cushioning element, provide increased cushioning to the wearer of the shoe. It should also be understood, that each of the features may be used alone or in combination with other features to provide an improved shoe and ankle support system.

Figure 30:
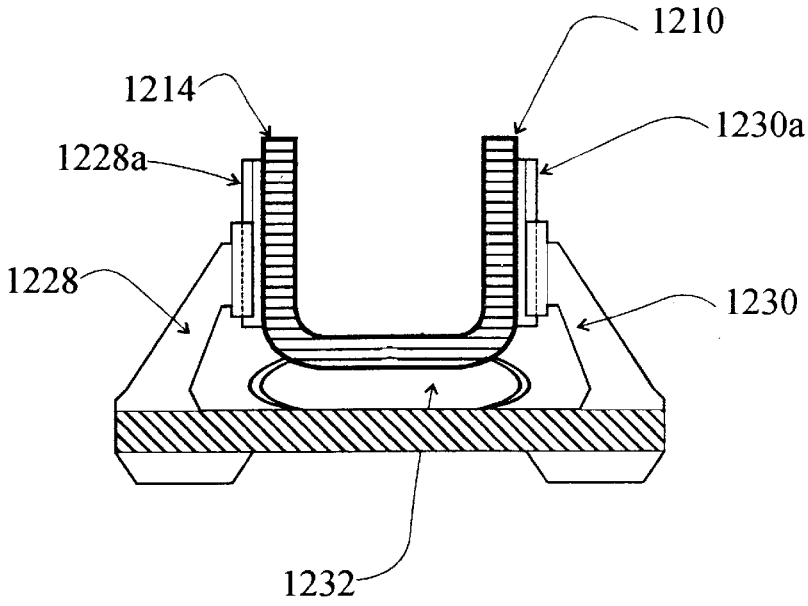
FIG. 30 is a similar view to FIG. 29 illustrating another embodiment of the lateral/medial braces.

Referring to FIGS. 30–35, several further variations of the cushioning element and lateral/medial supports are illustrated. As best seen in FIG. 30, lateral and medial supports 1228 and 1230 comprise rigid braces which slide in or on track 1228*a* and 1230*a*, which are provided on lateral and medial sides of shell 1214 of shoe 1210. Tracks 1228*a* and 1230*a* may be fastened to or formed, such as by molding, on the sides of shell 1214. In this manner, supports 1228 and 1230 provide lateral support but do not generally restrict the vertical movement of the heel area of shoe 1210. It should be understood that the tracks can be provided on the sole, with the shell incorporating downwardly extending angled braces. Similar to the previous embodiments, supports 1228 and 1230 provide lateral support at the ankle joint and, further, transfer the reaction forces to the centroid of the ankle joint, as described previously. The heel area of shoe 1210 also optionally includes a cushioning element 1232, such as described in reference to the previous embodiments, which is positioned between shell 1214 and sole 1212.

In addition, tracks 1228*a* and 1230*a* may include high friction surfaces to increase the resistance between supports 1228 and 1230 and shell 1214 and, thereby, provide some vertical resistance as well.

Figure 31:
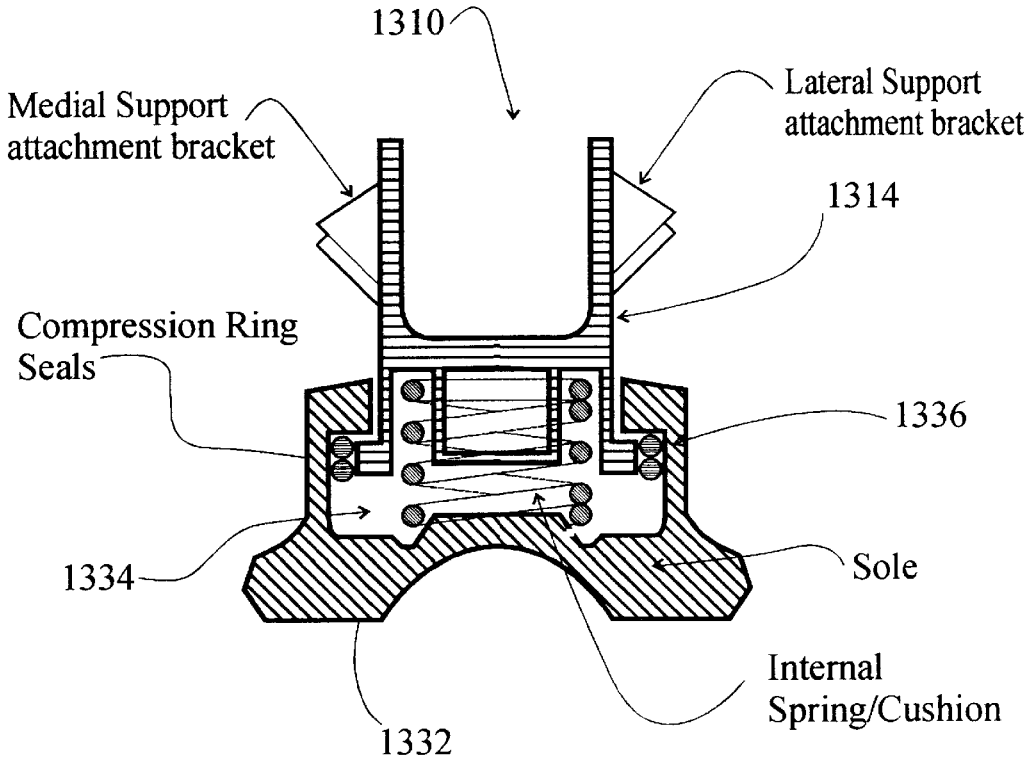
FIG. 31 is a cross-section similar to FIG. 29 illustrating another embodiment of a cushioning element.

As best seen in FIG. 31, shoe 1310 incorporates a coil spring cushioning element 1332. Cushioning element 1332 is positioned below heel area of shell 1314 in a chamber 1334. Chamber 1334 is optionally pressurized to increase the resistance provided by cushioning element 1332. As best seen in FIG. 31, chamber 1334 is defined between shell 1314 and sole 1312 and is sealed, for example by compression seals 1336, such as by compression rings, or neoprene gaskets. Cushioning element 1332 may be used alone or in combination with lateral or medial supports (not shown) similar to those described in reference to the previous embodiments. In the illustrated embodiment, shell 1314 includes abutments or anchors to which the supports may be mounted. Alternately, as noted previously, the lateral and medial supports may be incorporated into the shell and/or sole to provide an integrated suspension system.

Figure 32:
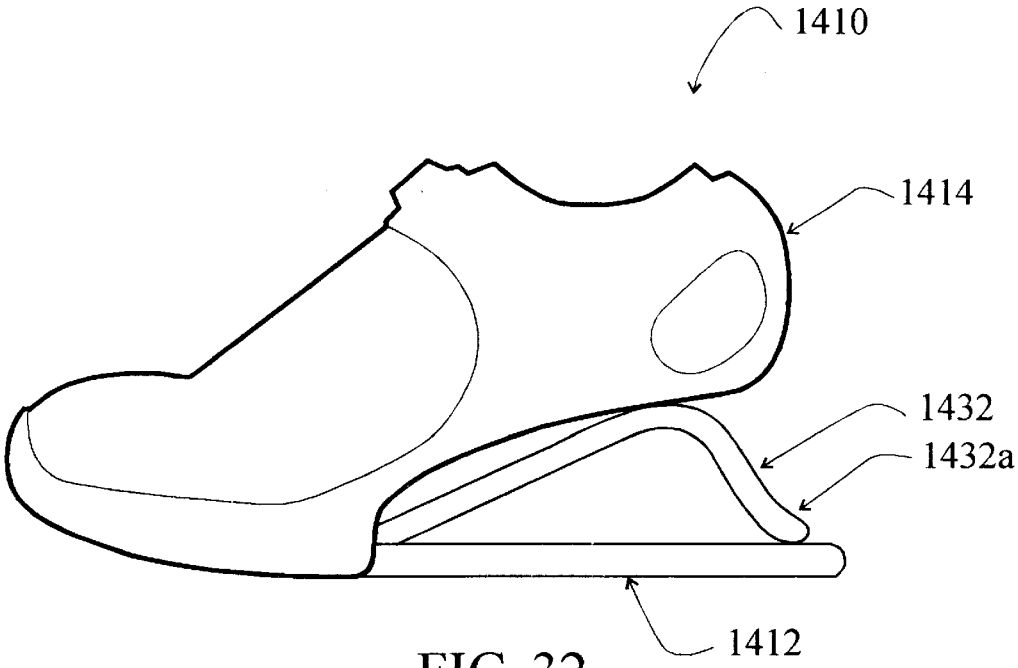
FIG. 32 is a fragmentary lateral view of a shoe illustrating another embodiment of a cushioning element.

Referring to FIG. 32, cushioning element 1432 comprises a leaf spring 1432*a*. Leaf spring 1432*a* is positioned below the heel area of shell 1414 between shell 1414 and sole 1412 and extends from the back of shoe 1410 inwardly toward the toe area. Cushioning element 1432 may be optionally combined with the lateral and medial supports described in reference to the previous embodiments to provide a combined spring suspension system.

Figure 33:
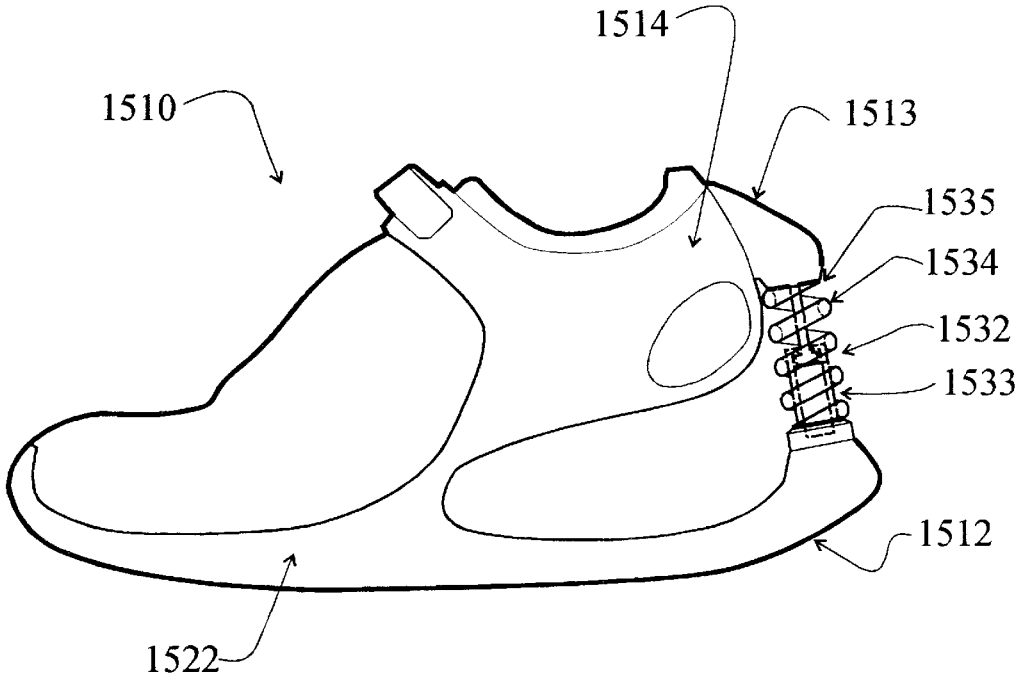
FIG. 33 is a view similar to FIG. 32 illustrating another embodiment of a cushioning element.

Referring to FIG. 33, cushioning element 1532 comprises a shock/spring element. Cushioning element includes a sleeve 1533 and a downwardly extending shaft 1434 which extends into sleeve 1533 and is sealed in sleeve 1533 by an O-ring seal or the like, to form a shock absorber. Shaft 1534 and sleeve 1533 may be formed from a plastic material or a metal material, such as stainless steel, die-cast metals, preferably light-weight die cast metals or the like. Extending around sleeve 1534 and sleeve 1533 is a coil spring 1535 which together with the shock absorber form cushioning element 1532. Optionally, the pressure in sleeve 1533 may be adjusted to vary the resistance of the shock absorber.

In the illustrated embodiment, cushioning element 1532 extends between sole 1512 of shoe 1510 and an abutment 1513 provided on the back end of shell 1514. Optionally, cushioning element 1532 may be curved and configured to provide a curved range of motion, which generally follows and is generally parallel to the motion of the heel area of shoe 1510 about pivot point 1522. It should also be understood, that cushioning element 1532 may be combined with any one of the lateral and medial supports described in reference to the previous embodiments.

Figure 34:
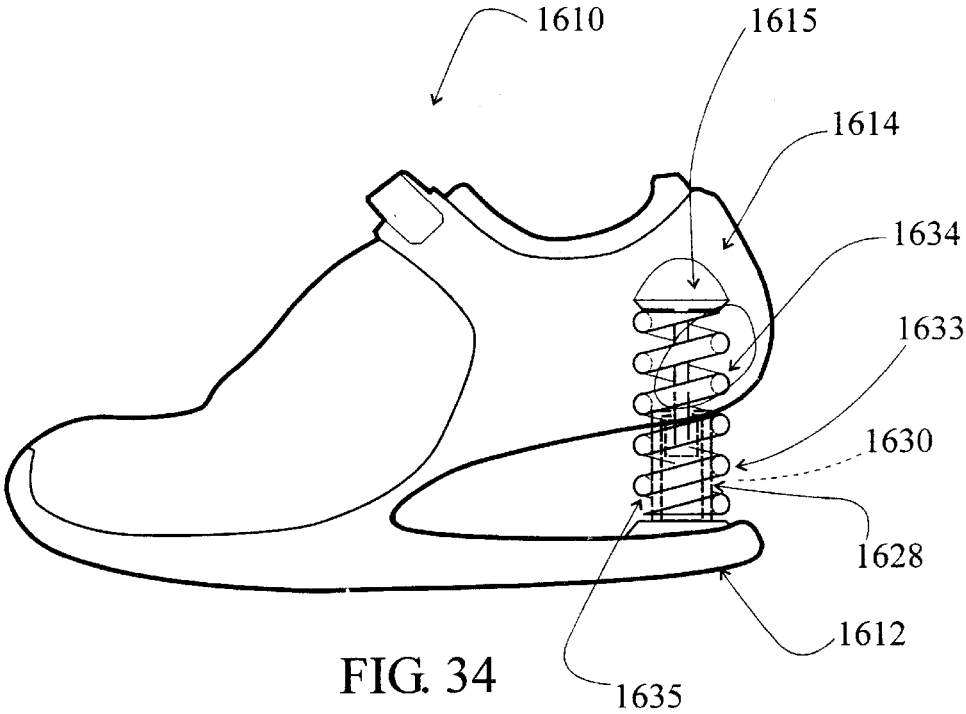
FIG. 34 is a similar view to FIG. 32 illustrating another embodiment of the lateral/medial springs.

Referring to FIG. 34, the numerals 1628 and 1630 generally designate another embodiment of the lateral and medial supports of the present invention. In the illustrated embodiment, each support 1628, 1630 comprises a shock/spring element, similar to cushioning element 1532, and includes a sleeve 1633 and a shaft 1634 which extends into and is sealed in sleeve 1633 to form a pressurized shock absorber. Sleeve 1633 is preferably pressurized with a gas or fluid to form a cylinder. In addition, cushioning element 1628 incorporates a coil spring 1635 which extends around shaft 1634 and sleeve 1633. Supports 1628, 1630 extend between shell 1614 and sole 1612 and are mounted to shell on abutments 1615 formed or otherwise provided on the side of shell 1614.

Figure 35:
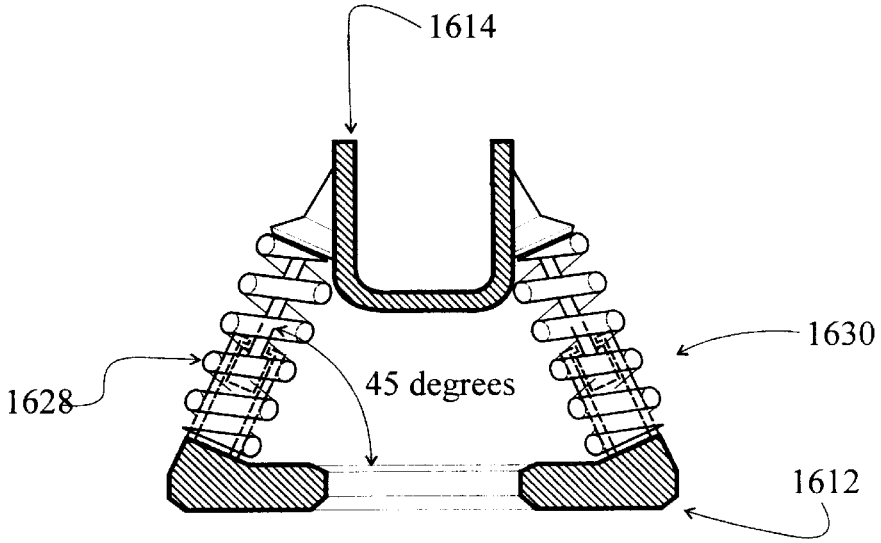
FIG. 35 is an anterior view of the shoe of FIG. 34.

Referring to FIG. 35, lateral and medial supports 1628 and 1630 are angled inwardly from sole 1612. In this manner, supports 1628, 1630 provide both lateral and vertical support to the heel area of shoe 1610. In this manner, supports 1628 and 1630 provide both the cushioning function of the cushioning elements and the lateral support provided by medial and lateral supports described in reference to the previous embodiments. As will be understood by those skilled in the art, the angular orientation of supports 1628 and 1630 may be varied depending on the width of sole 1612, with the angle optionally decreasing as the width of the sole increases. In the illustrated embodiment, supports 1628 and 1630 are angled approximately 45° with respect to sole 1612. However, it can be appreciated, that the angle may be varied.

Figure 36:
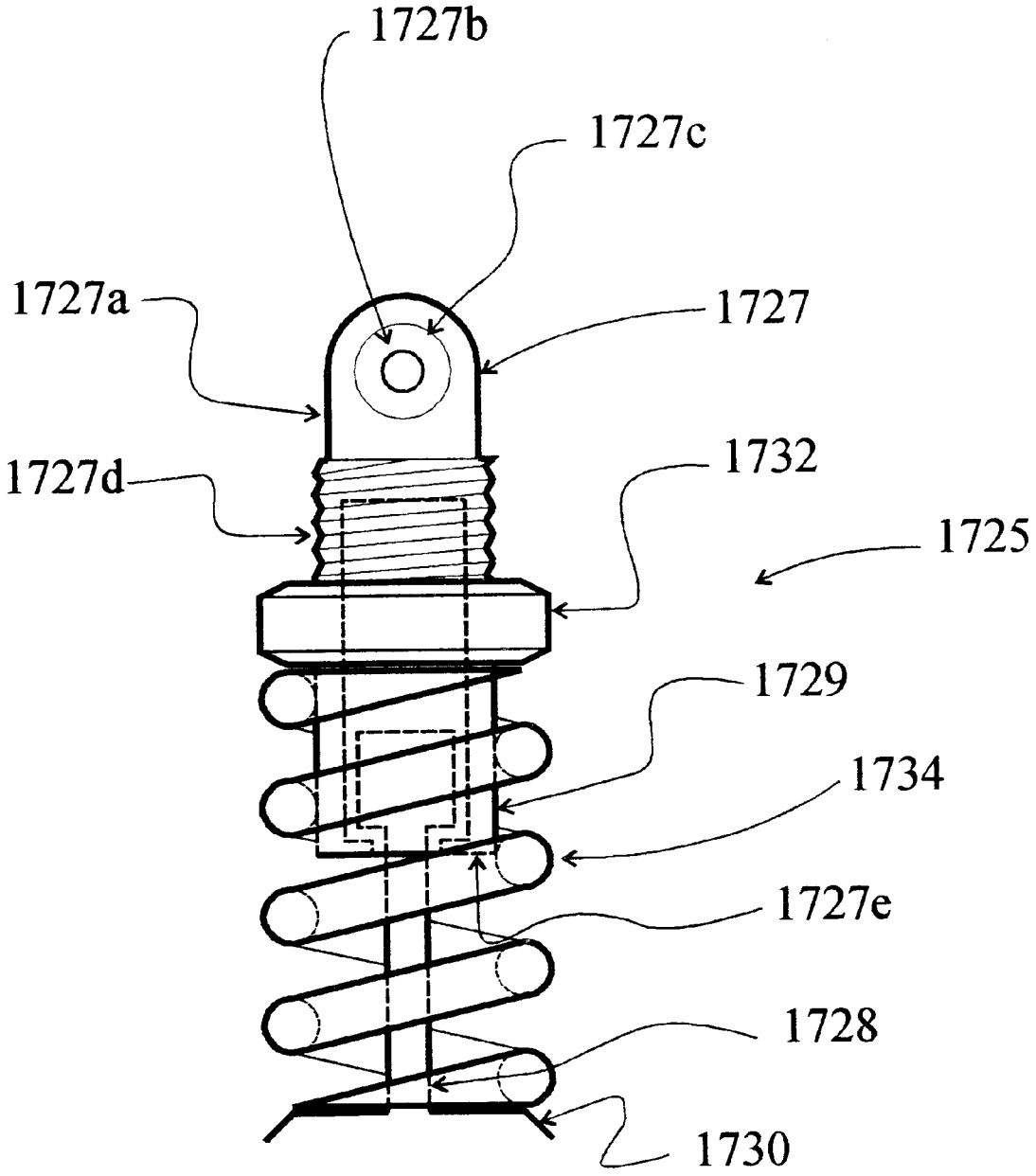
FIG. 36 is an enlarged view of another embodiment of a stabilizing bar.

Referring to FIG. 36, the numeral 1725 generally designates another embodiment of a lateral or medial support of the present invention. Support 1725 includes a tubular member 1727, which is rotatably mounted on a retaining pin 1728. Member 1727 includes a mounting tab or ear 1727*a* with hinge pin 1727*b* that extends transversely though ear 1727*a*. Pin 1727*b* may be supported in ear 1727*a* by bushing 1727*c* to permit limited pivoting of pin 1727*b* in ear 1727*a*. Member 1727 also includes a threaded portion or sleeve 1727*d* into which enlarged end 1729 of pin 1728 is rotatably mounted and captured by an end flange 1727*e* of sleeve 1727*d*. Pin 1728 includes a base 1730, which is fixed to the shoe, for example at the sole of the shoe. Threaded portion 1727*d* supports a threaded collar 1732. Positioned between collar 1732 and base 1730 is a spring 1734 whose compression is adjusted by the positioning of collar 1732 along threaded portion 1727*a*. In this manner, a wearer of the shoe may adjust the stiffness or resistance of support 1725 by merely rotating collar 1732 about threaded portion 1727*d*. Pin 1727*b* is mounted to the shell of the shoe, for example, preferably near or at the collar of the shoe to thereby transfer forces from the sole to the region at or near the collar of the shoe, similar to the supports of the previous embodiments.

From the forgoing it can be appreciated that the various embodiments of the shoe of the present invention provide suspension systems that reduces the risk of ankle sprain and injury and, further, reduce the effect of impact forces on the users joints, including knees. The shoe decouples the lateral forces from the vertical forces so that the lateral forces can be transferred to or near to the height of the ankle joint centroid, thus reducing or eliminating the risk of overturning moments in the ankle that can cause injury while at the same time allowing the ankle to maintain its full range of motion. In addition, the shoe is light weight and optionally adjustable to suit users of different body weight and a wide variety of activities, both athletic and non-athletic. Furthermore, although the several adjustable features of the shoe are described as being manually actuated by the wearer of the shoe, the various adjustments may be made by a control system. In which case, the control system would also include one or more sensors to detect, for example, the stress and strain in the shoe, especially in its suspension system, to use as input to the adjust the various components. Such a control system may, for example, incorporate micro-controllers. In addition, as already noted, the various components described herein can be used alone or in combination.

While several forms of the invention have been shown and described, other forms will now be apparent to those skilled in the art. Therefore, it will be understood that the embodiments shown in the drawings and described above are merely for illustrative purposes, and are not intended to limit the scope of the invention which is defined by the claims which follow as interpreted under the principles of patent law including the doctrine of equivalents.

I claim:

1. An article of footwear comprising:

a sole;

an upper portion comprising a shell for enclosing a user's foot therein, said shell having a portion for extending at least partially around a user's ankle, the user's ankle having an ankle joint at a height above the sole; and a suspension system extending between said upper portion and said sole, said suspension system including an energy storage member, said energy storage member transferring reaction forces generated at said sole from said sole to said shell generally at said portion for extending to thereby transfer the reaction forces to the height of the ankle joint of the user's ankle whereby said energy storage member eliminates/reduces overturning moment forces on the user's ankle when lateral forces are applied in said article of footwear wherein said energy storage member comprises a first energy storage member, said article comprising a second energy storage member, said first energy storage member having a first spring constant, and said second energy storage member having a second spring constant.

2. The article of footwear according to claim 1, wherein said first energy storage member comprises a flexible body.

3. The article of footwear according to claim 2, wherein said flexible body comprises a leaf spring.

4. The article of footwear according to claim 2, wherein said springs comprise plastic leaf springs.

5. The article of footwear according to claim 1, wherein said second energy storage member comprises a compressible body.

6. The article of footwear according to claim 5, wherein said first energy storage member comprises a pair of springs, one of said springs located at a medial side of said article, and an other of said springs being located at a lateral side of said article.

7. The article of footwear according to claim 6, wherein said springs comprise leaf springs.

8. The article of footwear according to claim 1, wherein said sole includes at least one enlarged area, said enlarged area extending laterally outward from a central longitudinal axis of said sole.

9. The article of footwear according to claim 8, wherein said enlarged area extends outward along a lateral axis extending through a centroid of an ankle of a wearer of said article.

10. The article of footwear according to claim 9, wherein a tangent line to said enlarged area extends though said lateral axis, said tangent line forming an angle in a range of about 40 degrees to 80 degrees with respect to said lateral axis.

11. The article of footwear according to claim 8, wherein said enlarged area extends outwardly along a lateral axis extending outwardly from a toe region of said sole.

12. The article of footwear according to claim 11, wherein a tangent line to said enlarged area extends though said lateral axis, said tangent line forming an angle in a range of about 40° to 80° with respect to said lateral axis.

13. The article of footwear according to claim 8, wherein said sole includes first and second enlarged areas, said first enlarged area extending outward along a lateral axis generally extending through a centroid of an ankle of a wearer of said article, and said second enlarged area extending outward along a lateral axis generally extending through a toe region of said sole.

14. The article or footwear according to claim 1, wherein said upper portion includes a lateral arch support and a medial arch support, said lateral arch support extending downwardly from said portion for extending to said sole on a lateral side of said article, and said media arch extending downwardly from said portion for extending to said sole.

15. The article of footwear according to claim 1, wherein said portion for extending comprises a collar.

16. The article of footwear according to claim 1, wherein said first spring constant is greater than said second spring constant.

17. An article of footwear comprising:

a sole;

an upper portion coupled to said sole, said upper portion comprising a shell for enclosing a user's foot therein and having a portion for extending at least partially around a user's ankle, the user's ankle having an ankle joint at a height from said sole; and a suspension system extending between said upper portion and said sole, said suspension system including a first energy storage member and a second energy storage member, said suspension system transferring reaction forces generated at said sole from said sole to said shell generally at said portion for extending to thereby transfer the reaction forces to the height of the ankle joint of the user's ankle whereby said suspension system eliminates/reduces overturning moment forces on the user's ankle when lateral forces are applied in said article of footwear, and said first energy storage member providing a first resistance over a first range of motion for a wearer of said article, and said second energy storage member providing a second resistance over a second range of motion for the wearer of said article.

18. The article of footwear according to claim 17, wherein said sole includes at least one enlarged area, said enlarged area extending laterally outward from said central longitudinal axis along one of said first and second lateral axes, said sole further including a tangent line at said enlarged area intersecting said one of said first and second lateral axes, and said tangent line forming an angle in a range of about 40° to 80° with respect to said one of said first and second lateral axes.

19. The article of footwear according to claim 18, wherein said enlarged area extends outward along said first lateral axis.

20. The article of footwear according to claim 18, wherein said enlarged area extends outward along said second lateral axis.

21. The article of footwear according to claim 18, wherein said enlarged area comprises a first enlarged area, said sole including a second enlarged area, said first enlarged area extending outward along said first lateral axis, and said second enlarged area extending outward along said second lateral axis.

22. The article of footwear according to claim 17, wherein said first resistance is greater than said second resistance.

23. The article of footwear according to claim 17, wherein said first energy storage member deflects from an uncompressed state to a compressed state over a first range of motion and provides said first resistance over said range of motion.

24. The article of footwear according to claim 17, wherein said second energy storage member deflects from a first state to a second compressed state over a second range of motion and provides said second resistance over said second range of motion.

25. The article of footwear according to claim 17, wherein said first energy storage member extends between said upper portion arid said sole, said first energy storage member transferring reaction forces from said sole to said shell generally at said portion for extending whereby said first energy, storage member reduces overturning moment forces on the user's ankle when lateral forces arc applied in said article of footwear.

26. The article of footwear according to claim 17, wherein said sole includes at least one enlarged area to increase stability of said article, said enlarged area extending laterally or medially outward from a central longitudinal axis of said sole.

27. The article of footwear according to claim 17, wherein said sole includes first and second lateral axes, said first lateral axis extending generally orthogonal to said longitudinal axis at said heel region, and said second lateral axis extending generally orthogonal to said longitudinal axis at said toe region, said enlarged area extending outwardly from said central longitudinal axis along one of said first and second lateral axes.

28. The article of footwear according to claim 27, wherein said enlarged area comprises a first enlarged area, said sole including a second enlarged area, said first enlarged area extending outward along said first lateral axis, and said second enlarged area extending outward along said second lateral axis.

29. The article of footwear according to claim 17, wherein said first energy storage member comprises a pair of leaf springs extending between said upper portion and said sole, said leaf springs transferring reaction forces from said sole to said shell generally at said portion for extending to thereby transfer said reaction forces to the height of the ankle joint whereby said leaf springs reduce moment forces on the user's ankle when the user leans in said article of footwear and further provides cushioning to the user's joints.

30. The article of footwear according to claim 29, wherein said upper portion includes a medial side and a lateral side, one of said springs being located at said medial side, and the other of said springs being located at said lateral side.

31. The article of footwear according to claim 29, wherein said springs comprise plastic leaf springs.

32. The article of footwear according to claim 29, wherein said springs are releasably mounted to said upper portion and said sole.

33. The article of footwear according to claim 29, wherein said second energy storage member comprises a cushioning member between said upper portion and said sole.

34. The article of footwear according to claim 33, wherein said cushioning member comprises a compressible body.

35. The article of footwear according to claim 29, wherein said sole includes at least one enlarged area, said enlarged area extending laterally outward from a central longitudinal axis of said sole.

36. The article of footwear according to claim 17, wherein said portion for extending comprises a collar.

* * * * *

UNITED STATES PATENT AND TRADEMARK OFFICE

CERTIFICATE OF CORRECTION

PATENT NO. : 6,557,271 B1
APPLICATION NO. : 09/878021
DATED : May 6, 2003
INVENTOR(S) : Robert B. Weaver, III It is certified that error appears in the above-identified patent and that said Letters Patent is hereby corrected as shown below:

Column 8:
Line 20, Insert --of the range-- after "1/3"

Column 9:
Line 25, "for any-angle" should be --form an--

Column 15:
Line 62, "60°.In" should be --60°. In--

Column 19:
Line 24, Claim 14, "or" should be --of--
Line 28, Claim 14, "media" should be --medial--

Column 20:
Line 24, Claim 25, "arid" should be --and--
Line 27, Claim 25, Delete "," after "energy"
Line 27, Claim 25, "arc" should be --are--

Signed and Sealed this

Twentieth Day of February, 2007

JON W. DUDAS
*Director of the United States Patent and Trademark Office*